US009356364B2

(12) United States Patent
Chastain et al.

(10) Patent No.: US 9,356,364 B2
(45) **Date of Patent: *May 31, 2016**

(54) COAXIAL CABLE CONNECTOR WITH CONTINUITY BUS

(71) Applicant: PERFECTVISION MANUFACTURING, INC., Little Rock, AR (US)

(72) Inventors: Robert J. Chastain, Maumelle, AR (US); Charles D. Davidson, Jr., Little Rock, AR (US); Glen David Shaw, Conway, AR (US)

(73) Assignee: PERFECTVISION MANUFACTURING INC, Little Rock, AR (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/791,395

(22) Filed: Jul. 3, 2015

(65) Prior Publication Data

US 2015/0340778 A1 Nov. 26, 2015

Related U.S. Application Data

(63) Continuation-in-part of application No. 14/540,995, filed on Nov. 13, 2014, now Pat. No. 9,077,089, which is a continuation-in-part of application No. 14/245,919, filed on Apr. 4, 2014, now Pat. No. 9,105,988.

(60) Provisional application No. 61/822,834, filed on May 13, 2013.

(51) Int. Cl.
*H01R 9/05* (2006.01)
*H01R 103/00* (2006.01)

(52) U.S. Cl.
CPC ..... *H01R 9/0512* (2013.01); *H01R 9/0521* (2013.01); *H01R 9/0527* (2013.01); *H01R 2103/00* (2013.01)

(58) Field of Classification Search
CPC ..... H01R 17/12
USPC ..... 439/578, 579, 675, 352
See application file for complete search history.

(56) References Cited

U.S. PATENT DOCUMENTS

| | | | | |
|---|---|---|---|---|
| 6,352,448 | B1 | 3/2002 | Holliday et al. | |
| 7,189,114 | B1 | 3/2007 | Burris et al. | |
| 7,311,554 | B1 | 12/2007 | Jackson et al. | |
| 7,892,024 | B1 | 2/2011 | Chen | |
| 9,105,988 | B2 * | 8/2015 | Chastain | H01R 9/0512 |
| 9,190,773 | B2 * | 11/2015 | Shaw | H01R 13/622 |
| 9,203,167 | B2 * | 12/2015 | Holliday | H01R 9/05 |
| 2006/0246774 | A1 | 11/2006 | Buck | |
| 2007/0224880 | A1 | 9/2007 | Wlos et al. | |
| 2011/0230091 | A1 | 9/2011 | Krenceski et al. | |
| 2011/0306236 | A1 | 12/2011 | Addario et al. | |
| 2013/0102189 | A1 | 4/2013 | Montena | |

FOREIGN PATENT DOCUMENTS

JP 2010146836 A 7/2010

* cited by examiner

*Primary Examiner* — Phuongchi T Nguyen
(74) *Attorney, Agent, or Firm* — Paul D. Chancellor; Ocean Law; Robert E. Fahr, Jr.

(57) ABSTRACT

A coaxial cable connector includes a continuity bus that extends a ground circuit from a coaxial cable outer conductor to a connector part such as a connector fastener and/or a connector post.

9 Claims, 37 Drawing Sheets

FIG. 1D

100D

| Part | Path 1 | Path 2 | Path 3 | Path 4 | Path 5 |
|---|---|---|---|---|---|
| 1. Coaxial Cable Outer Conductor | X | X | X | X | X |
| 2. Continuity Bus | | | X | X | X |
| 3. Post | X | X | | X | X |
| 4. Fastener | X | | X | | X |
| 5. Port | X | X | X | X | X |

COAXIAL CABLE CONNECTOR WITH CONTINUITY BUS

PRIORITY CLAIM AND INCORPORATION BY REFERENCE

This application is a continuation-in-part of U.S. patent application Ser. No. 14/540,995 filed Nov. 13, 2014 which is a continuation-in-part of U.S. patent application Ser. No. 14/245,919 filed Apr. 4, 2014 and entitled COAXIAL CABLE CONNECTOR WITH CONTINUITY BUS which claims the benefit of U.S. Prov. Pat. App. No. 61/822,834 filed May 13, 2013 and entitled COAXIAL CABLE CONNECTOR WITH CONTINUITY BUS, all of which are incorporated herein in their entireties and for all purposes.

BACKGROUND OF THE INVENTION

Coaxial cable connectors are well-known in various applications including those of the satellite and cable television industry. Coaxial cable connectors including F-Type connectors used in consumer applications such as cable and satellite cable connectors are a source of service calls when service is interrupted by lost and/or intermittent coaxial cable connections typically involving a junction between a male F-type connector terminating a coaxial cable and a female F-type port located on related equipment.

1. Field of Invention

This invention relates to the electromechanical arts. In particular, an electrical connector incorporates a center conductor and a ground conductor surrounding the center conductor.

2. Discussion of the Related Art

Coaxial cable connectors include variants designed to improve electrical continuity under extenuating circumstances. These continuity improving connectors have generally utilized assemblies of bare electrical conductors in a multipart ground circuit interconnecting the outer conductor of a coaxial cable and the grounded casing of a female F-type port.

SUMMARY OF THE INVENTION

Embodiments of the continuity bus of the present invention provide an electrical ground path between a coaxial cable outer conductor and an electrically conducting fastener of the connector such that the connector ground circuit tends to be maintained during events including movement of the connector fastener relative to the connector body and failure to properly tighten the connector fastener to a female port.

The present invention provides a coaxial connector with a continuity bus. Embodiments provide a continuity bus embedded in a peripheral non-conductive connector body wall such as a cylindrical body wall.

In an embodiment, a coaxial cable connector comprises: a tubular body defining a cylindrical wall section made from an insulating material; the tubular body for receiving a prepared end of a coaxial cable with a central signal conductor spaced apart from an exposed ground conductor; a fastener incorporating an electrically conductive material, the fastener rotatably coupled to the tubular body; an elongated continuity bus having a first contact portion operable to electrically contact the exposed ground conductor and a second contact portion operable to rub the rotatable fastener; and, at least a portion of the continuity bus embedded in the wall section of the tubular body.

In another embodiment, the above connector's electrical contact between the fastener and the continuity bus second contact portion is maintained if the fastener is moved away from the body.

And in yet another embodiment, the above connector's electrical contact between the fastener and the continuity bus second contact portion is maintained if the fastener is moved toward the body.

BRIEF DESCRIPTION OF THE DRAWINGS

The present invention is described with reference to the accompanying figures. These figures, incorporated herein and forming part of the specification, illustrate the present invention and, together with the description, further serve to explain the principles of the invention and to enable a person skilled in the relevant art to make and use the invention.

FIG. 1D shows electrical grounding paths in tabular format.

FIGS. 5E-Z and 5AA-AF show cross-sectional and perspective views of continuity bus configurations.

DETAILED DESCRIPTION OF THE PREFERRED EMBODIMENTS

The disclosure provided in the following pages describes examples of some embodiments of the invention. The designs, figures, and descriptions are non-limiting examples of certain embodiments of the invention. For example, other embodiments of the disclosed device may or may not include the features described herein. Moreover, disclosed advantages and benefits may apply to only certain embodiments of the invention and should not be used to limit the disclosed inventions.

Figure 1A:
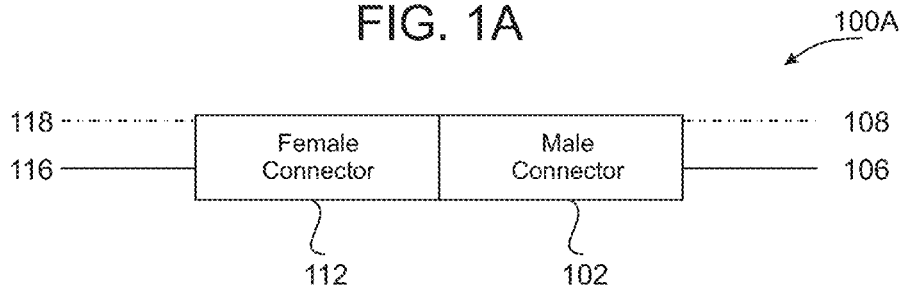
FIGS. 1A-C show coaxial cable connectors and mated coaxial cable connectors.

FIG. 1A shows a schematic of mated male 102 and female 112 coaxial cable connectors such as mated F-type connectors 100A. The mated connectors provide electrical continuity between respective central conductors 106, 116 and electrical continuity between respective outer conductors 108, 118. The outer conductors are commonly referred to as ground conductors.

Figure 1B:
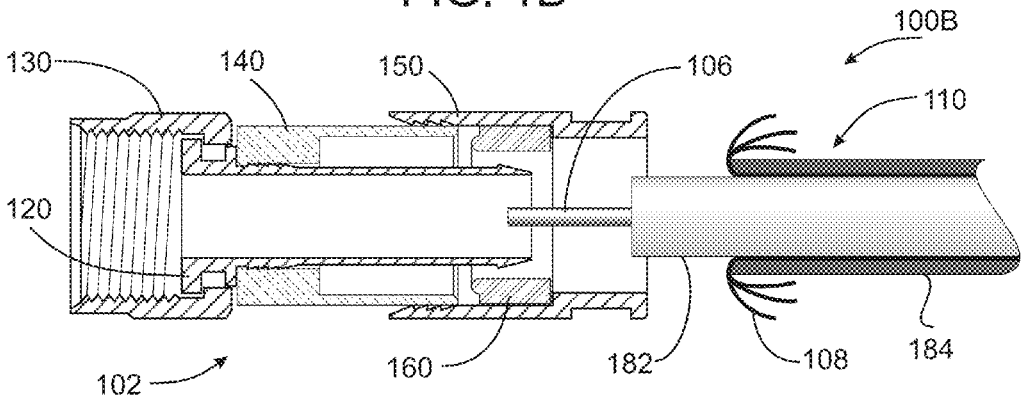

FIG. 1B shows an F-type male connector 102 before its attachment to a prepared end of a partially inserted coaxial cable 110 100B. The connector shown includes a fastener 130 coaxially arranged with a tubular body 140. The fastener is rotatable with respect to the tubular body. For example, embodiments include a post 120 rotatably coupling the fastener and the body. Further, some embodiments include a wedge part 160 movable with a rear shell 150 to fix the cable to the connector.

The coaxial cable 110 includes a dielectric 182 surrounding the central conductor. The outer conductor 108 surrounds the dielectric and an outer insulating jacket 184 envelops the dielectric and conductors.

Figure 1C:
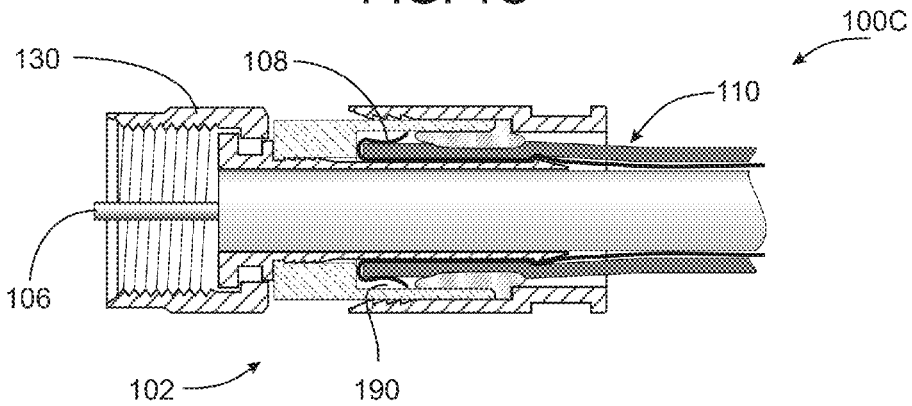

FIG. 1C shows an F-type male connector 102 after its attachment to the prepared end of the fully inserted coaxial cable 110 100C. As seen here, the outer conductor is positioned in an annular space 190 between the body 140 and the post 120, and the rear shell 150 is moved forward, pushing the wedge part 160 into an annular space between the coaxial cable and the body so as to fix the cable to the connector.

FIG. 1D shows connector ground paths 100D. These ground paths do not rely on an electrically conductive body, a useful feature when the body is made from non-conducting materials such as non-conducting plastics.

Path 1 is a ground path between a coaxial cable outer conductor and a female port ground. See for example the coaxial cable outer conductor 108 and female port ground 118. As shown (e.g. FIG. 1C), Path 1 passes through a post (e.g. post 120) and through a fastener (e.g. fastener 130).

Path 2 is a ground path between a coaxial cable outer conductor and a female port ground. See for example the coaxial cable outer conductor 108 and female port ground 118. As shown (e.g. FIG. 1C), the ground path passes through a post (e.g. post 120).

Path 3 is a ground path between a coaxial cable outer conductor and a female port ground. See for example the coaxial cable outer conductor 108 and female port ground 118. As shown (e.g. FIG. 3A), the ground path passes through a continuity bus 400A and through a fastener (e.g. fastener 130).

Path 4 is a ground path between a coaxial cable outer conductor and a female port ground. See for example the coaxial cable outer conductor 108 and female port ground 118. As shown (e.g., FIG. 5E), the ground path passes through a continuity bus and a post (e.g. post 5020).

Path 5 is a ground path between a coaxial cable outer conductor and a female port ground. See for example the coaxial cable outer conductor 108 and female port ground 118. As shown (e.g. FIG. 5E), the ground path passes through a continuity bus, a post (e.g. post 5020) and a fastener (e.g. fastener 5030).

Figure 2A:
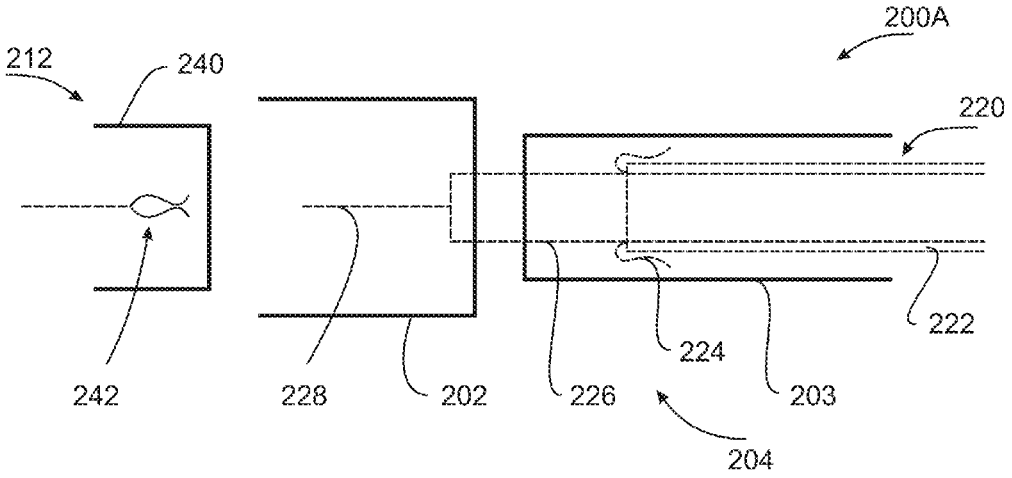
FIG. 2A shows a schematic diagram of a coaxial cable connector.

FIG. 2A shows a schematic of adjacent coaxial cable connectors 200A. A male coaxial connector such as an F-type connector 204 is adjacent to a female coaxial cable connector 212. As shown, the female coaxial connector includes a central signal contact 242 for contacting the center conductor 228 of a coaxial cable 220. The cable center conductor is surrounded by a dielectric 226 while an insulating jacket 222 covers the outer conductor 224.

As shown, the cable 220 is inserted through a male connector body 203. The body is made from a material that is not electrically conductive. The male connector includes a fastener 202 for engaging the female port such as the female connector ground 240 and, in various embodiments the fastener and the body are rotatably engaged, for example by a post (not shown).

Figure 2B:
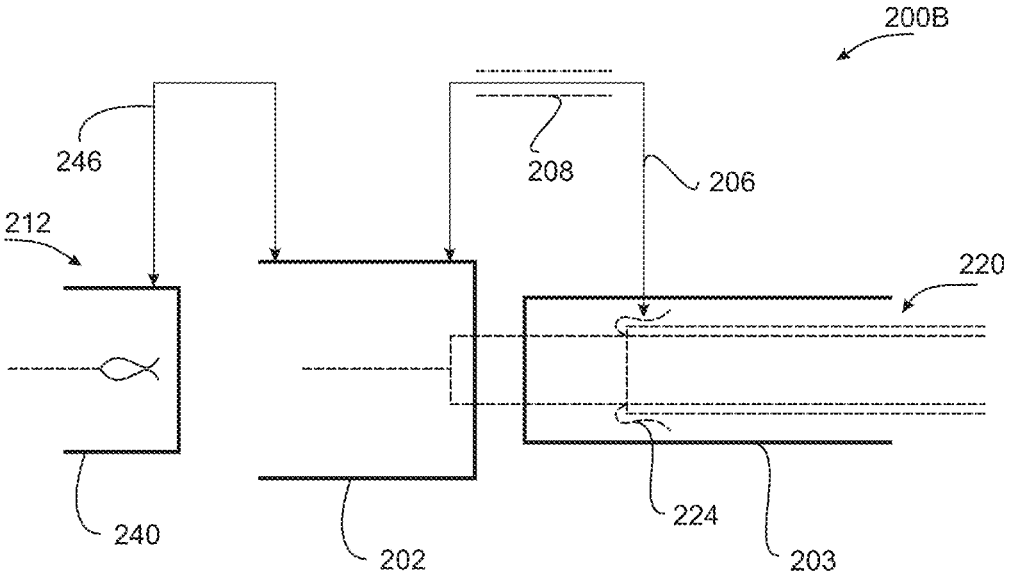
FIG. 2B shows a schematic diagram of a coaxial cable connector including a continuity bus.

FIG. 2B shows a schematic of a connector that incorporates a continuity bus 200B. A ground path between the coaxial cable 220 outer conductor 224 and the female connector 212 ground 240 is also indicated. In particular, a continuity bus 206 electrically interconnects the coaxial cable's exposed outer conductor 224 with the electrically conductive fastener 202 of the male connector.

In various embodiments, at least portion(s) of the continuity bus penetrate the connector body. For example, in various embodiments at least portion(s) of the continuity bus are immovably or slidably embedded in a wall forming the connector body as shown by a continuity bus insulated portion 208.

The ground path to the female connector ground 212 is completed 246 when the male connector fastener 202 engages a female port such as the female connector ground 240. Similar to the depiction of FIG. 1A, this ground path interconnects a ground at a male connector (e.g. male connector ground 108) with a ground at the female connector (e.g. female connector ground 118). And, similar to Path 3 of FIG. 1D, a ground path between a coaxial cable outer conductor and a female port ground via a continuity bus and a fastener is described.

Figure 3A:
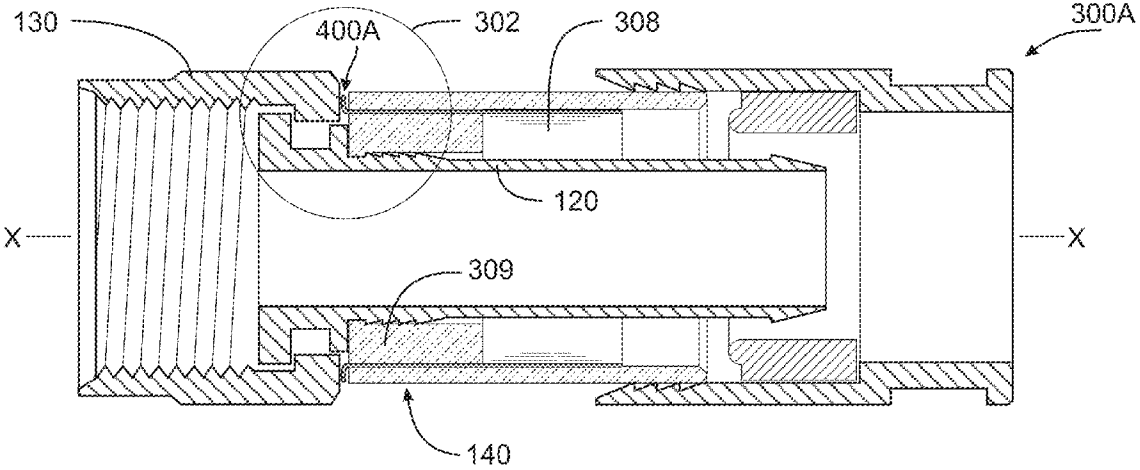
FIGS. 3A-D show cross-sectional views of a coaxial cable connector with a continuity bus.

FIG. 3A shows a connector that incorporates a continuity bus 300A. Notably, here and elsewhere in applicant's disclosure, exemplary connectors of particular design are used to illustrate making and using the present invention and the continuity bus of the present invention. Such descriptions are not to be used to limit the applicability of the inventive ideas expressed herein. Rather, they should be understood to teach inventive concepts applicable to various connectors through use of the selected example(s).

The exemplary connector of FIG. 3A includes a post 120, a suitable fastener such as a nut engaging the post 130 and a body 140. These parts are coaxially arranged with the post extending between and into each of the fastener and the body. A coaxial cable annular receiving space 308 is formed between the body and the post such that when the prepared end of a coaxial cable is inserted into the connector body, the cable outer conductor 108 is received in this space.

Figure 3C:
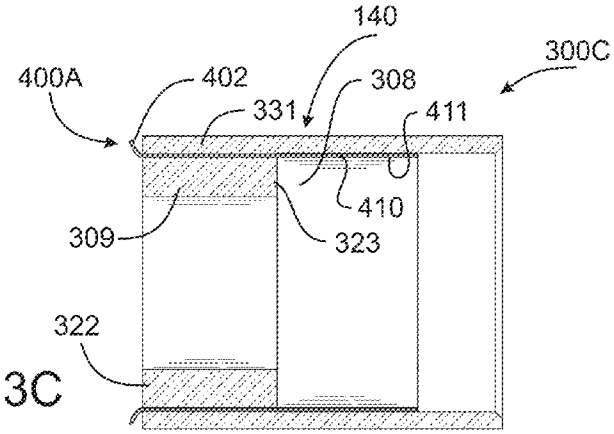
Figure 3B:
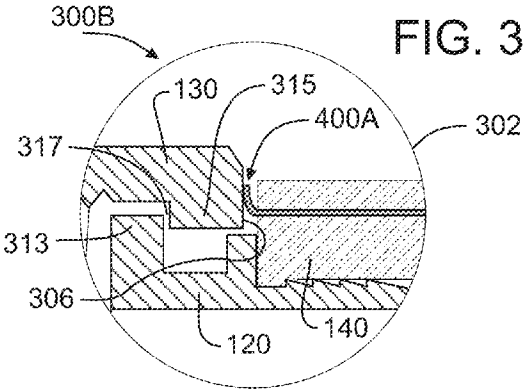

FIG. 3B shows an enlarged portion of the connector of FIG. 3A 300B. The enlarged portion 302 shows the fastener 130 to post 120 rotatable engagement and a body 140 to post attachment. In various embodiments, the fastener is coupled to the post via a post flange 313 that interengages an inwardly directed fastener rim 315. And, in various embodiments a body neck 309 surrounds and attaches to the post near the post flange.

FIG. 3C shows an enlarged view of the body of the connector of FIG. 3A 300C including a continuity bus 400A. As shown here, the continuity bus passes through a body wall or as shown through a portion of a cylindrical body wall 331 of the body 140. A portion of the continuity bus is fixedly embedded in the body wall. Notably, in some other embodiments discussed below, a continuity bus portion is movably embedded in a body wall.

Each of FIGS. 3A-C shows the continuity bus 400A. Shown best in FIG. 3C, the continuity bus is located in the body wall 331 such that a continuity bus fastener contact 402 is exposed, at least in part, near one end of the bus and a continuity bus outer conductor contact 410 is exposed, at least in part, near an opposite end of the bus.

In various embodiments, the fastener contact 402 protrudes from a neck end of the body 322 and in some embodiments is turned away from the connector centerline x-x (forming an "L" like shape as shown). And, in some embodiments, the continuity bus outer conductor contact 410 protrudes near a neck internal face 323 into the outer conductor receiver annulus 308 such that a surface of the outer conductor contact 411 faces the connector centerline.

When a body 140 with an integral continuity bus 400A is assembled in a connector, embodiments of the present invention provide for contact and/or following contact between the fastener and the fastener contact. In the present example, a spring-like action of the fastener contact maintains following contact between the fastener and the continuity bus.

In particular, assembly of the connector presses the fastener contact against the fastener back face 306 such that the fastener contact is resiliently moved toward the body. This action tends to resist formation of a gap 317 between the post flange 313 and the fastener rim 315. In various embodiments, the fastener contact acts to press the fastener rim 315 against the post flange 313 such that actions that would open the gap 317 are resisted by resilient operation of the fastener contact.

Figure 3D:
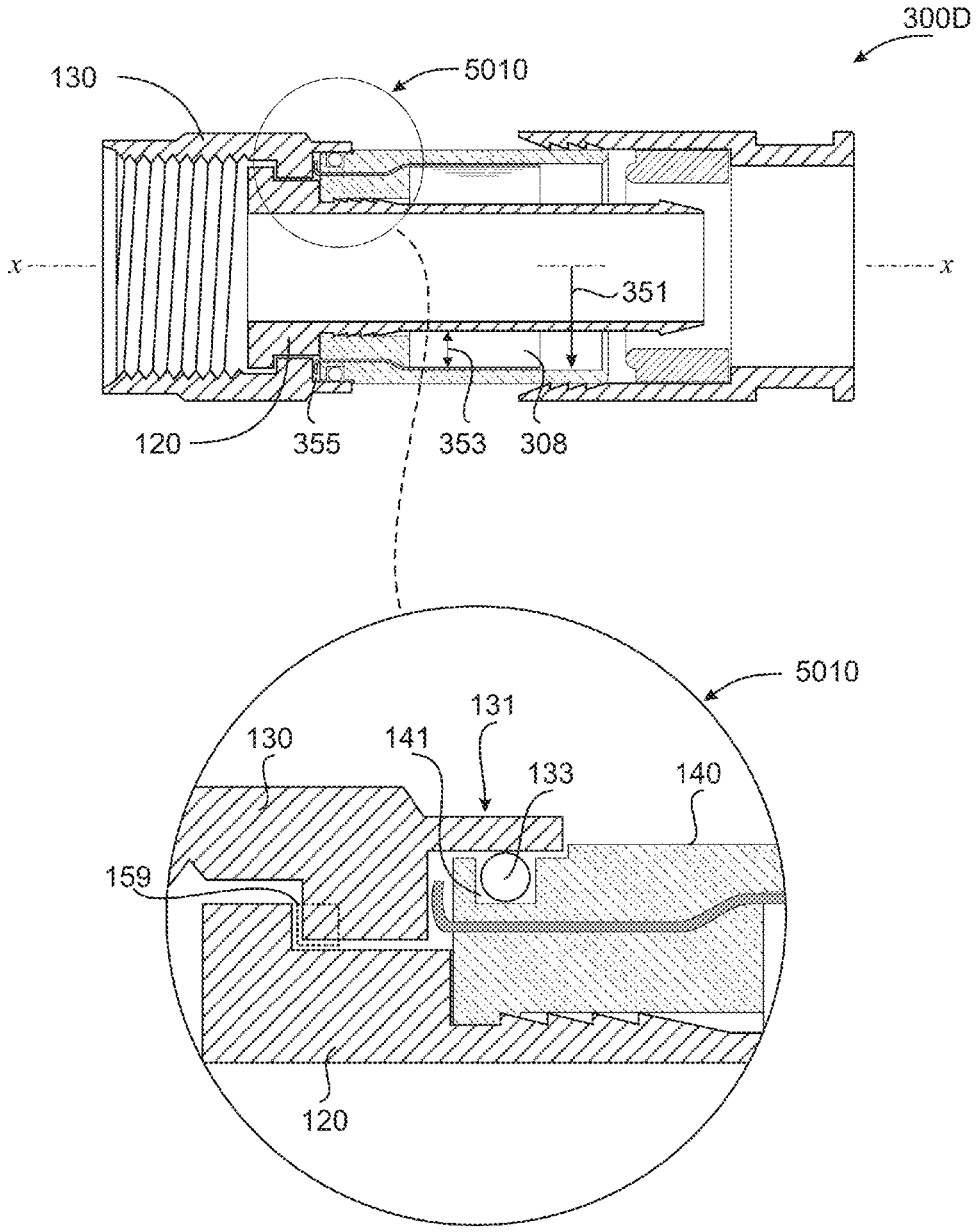

FIG. 3D shows a connector that incorporates a continuity bus 300D. As shown in the exploded zone 5010 and similar to the connector of FIG. 3A, this connector includes a trailing nut rim 131 that overhangs a nose 355 of the body 140. In particular, the nut rim encircles a circumferential body groove 141 holding an O-ring 133. In various embodiments, the O-ring provides a seal between the body and the nut. And, in various embodiments a continuity bus radius 351 extending from the connector X-X axis increases to expand a gap 353 associated with the cable receiving space 308.

In some embodiments, an insulating structure such as a plastic washer is interposed between the fastener 130 and the post 120. See for example the optional insulating washer 159. A fastener counterbore may be used to seat an insulating structure (as shown) or the structure may be used without a fastener counterbore. Embodiments using e.g., a counterbore and a plastic insulating washer may be configured as shown to radially insulate the fastener from the post and to longitudinally insulate the fastener from the post such that the fastener is electrically isolated from the post.

Figure 4A:
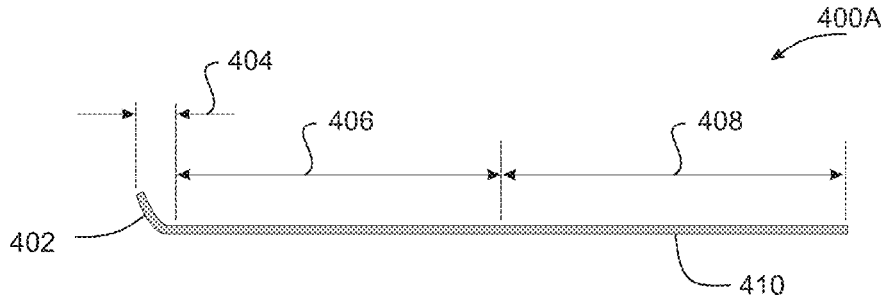
FIG. 4A shows a schematic view of a continuity bus.

FIGS. 4A-D show a first group of continuity bus embodiments 400A-D. In FIG. 4A, a continuity bus 400A includes a bus front projection 404, a rear projection 408 and a bus midsection 406 interconnecting the front and rear projections. The bus front projection includes the fastener contact 402 while the bus rear projection includes the outer conductor contact 410.

As shown in the embodiment above, the bus front projection 404 extends away from the body 140 and toward the fastener 130 and the fastener contact 402 is an end portion of the front bus projection. As shown in the embodiment above, the bus rear projection 408 extends within the body and the outer conductor contact 410 is an inwardly directed face of the bus rear projection. And, as shown in the embodiment above, the bus midsection 406 is embedded, at least in part, in the connector body periphery, for example in the connector body neck 309.

Continuity bus embodiments include busses formed from elongated wires, pins, and other suitable structures whether they have regular or irregular cross-sections. Continuity bus embodiments also include embodiments utilizing plural continuity bus parts such as use of multiple independent continuity bus pins. Other continuity bus embodiments include partial or complete figures of revolution such as circular sections. Yet other continuity bus embodiments combine bus portions that are figures of revolution, circular cross section for example, with portions that are not figures of revolution, fingers for example.

Figure 4B:
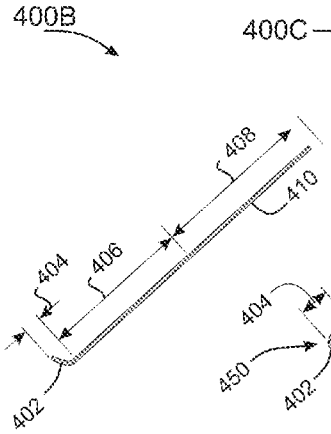
FIGS. 4B-D show perspective views of continuity bus embodiments.

FIG. 4B shows an elongated continuity bus in a form such as a wire or a pin 400B. As above, the bus has front and rear projections 404, 408 interconnected by a bus midsection 406. Bus terminations are a front contact 402 and an outer conductor contact 410.

Figure 4C:
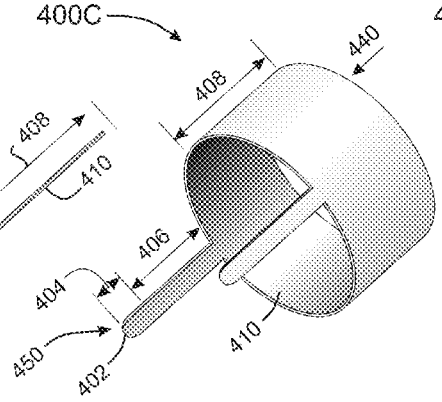

FIG. 4C shows a continuity bus including a generally circular section 400C. As shown, the generally circular section 440 forms the bus rear projection 408 and an inside surface of the circular section forms the outer conductor contact 410. Two fingers 450 extend from the circular section. Each finger includes at least a part of a bus midsection 406 and a bus front projection 404 terminating in a fastener contact 402.

Figure 4D:
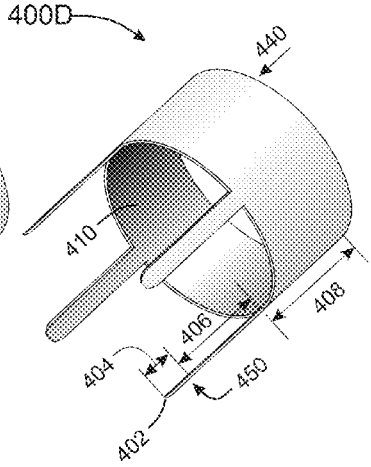

FIG. 4D shows another continuity bus including a generally circular section 400D. As shown, the generally circular section 440 forms the bus rear projection 408 and an inside surface of the circular section forms the outer conductor contact 410. Here, four fingers 450 extend from the circular section. Each finger includes a bus midsection 406 and a bus front projection 404 terminating in a fastener contact 402. Although there is generally a preference for a symmetrical arrangement of multiple fingers about a circular periphery, skilled artisans will recognize suitable arrangements provide one or more fingers.

As suggested by the above, various embodiments provide a fastener contact for rubbing against a portion of the fastener 130. In FIGS. 3A-C, embodiments provide a turned end of the continuity bus for rubbing against what is shown as a generally flat fastener back face 306. Other embodiments provide for alternative engagements between the fastener and the continuity bus. For example, the fastener may include a groove or protuberance for receiving or seating a mating continuity bus fastener contact.

Figure 5A:
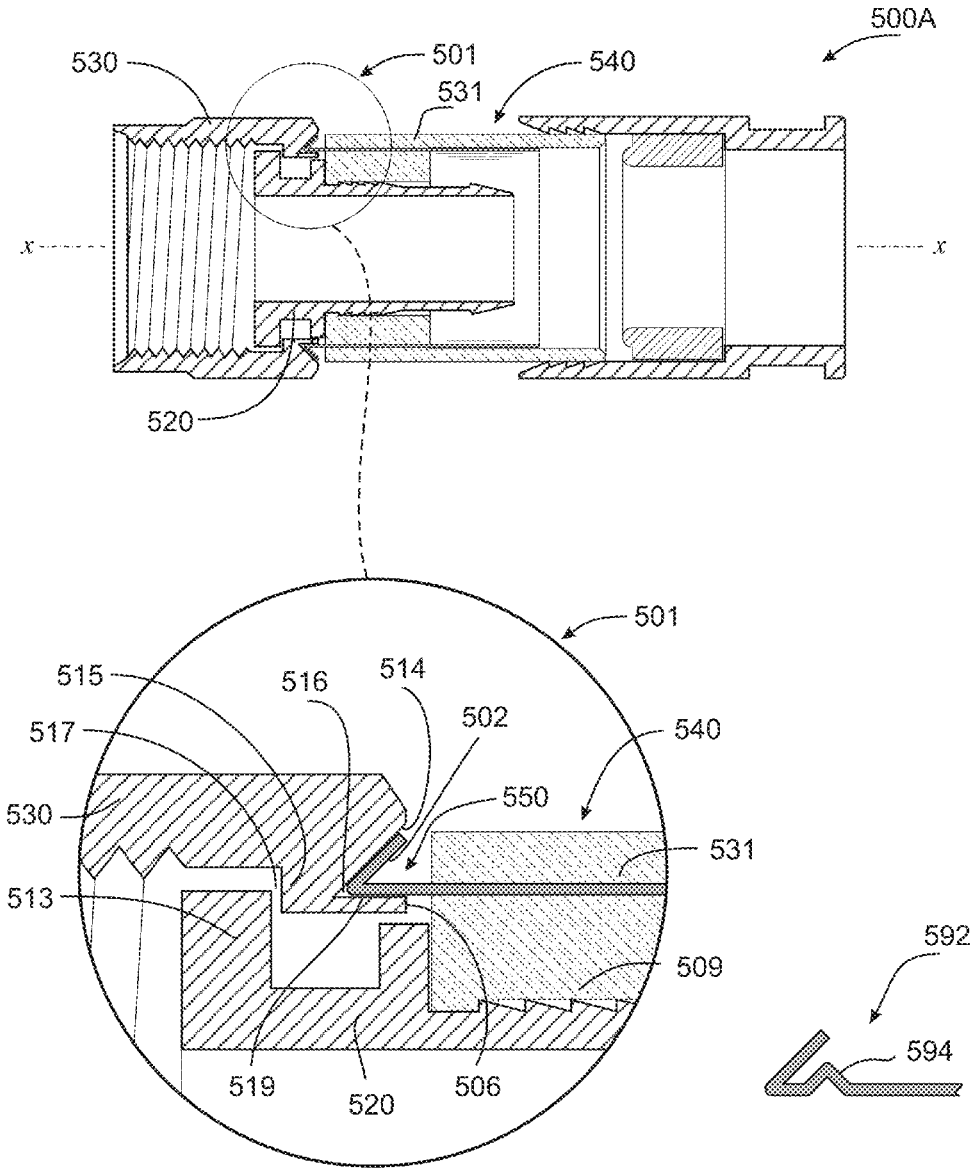
FIGS. 5A-D show cross-sectional views of continuity bus fastener contact configurations.

FIGS. 5A-D show embodiments of a continuity bus connector including fastener grooves 500A-500D. FIG. 5A shows a first continuity bus connector including a fastener groove 500A. The connector includes a post 520 and a fastener 530 adjacent to a body 540 having a body peripheral wall 531.

An enlarged connector portion 501 shows the fastener 530 to post 520 rotatable engagement and the body 540 to post attachment. In various embodiments, the fastener is coupled to the post via a post flange 513 that interengages an inwardly directed fastener rim 515. And, in various embodiments a body neck 509 surrounds and attaches to the post near the post flange.

The continuity bus 550 is located in the body wall 531 such that a continuity bus fastener contact 502 is exposed. As shown, the fastener contact is a portion of a front bus projection that is bent away from the connector centerline x-x to form a two segment arrow shaped fastener contact that is pointed into a fastener groove 516 encircling a back face 506 of the fastener (See e.g. FIGS. 4A-D). The fastener groove is generally "v" shaped and is configured to receive the arrow shaped fastener contact. In some embodiments, the fastener groove has a floor 519 about parallel to the connector centerline and a sloped ceiling 514 that is angled away from the connector centerline.

When the connector of FIG. 5A is assembled, embodiments provide for contact and/or following contact between the fastener contact and the fastener groove wall(s) 519, 514. In some embodiments, spring-like action of the fastener contact 502 maintains following contact between the fastener contact and the groove. In particular, assembly of the connector presses the fastener contact against a fastener groove wall(s), for example against the groove floor 519 and/or the groove ceiling 514. This action tends to resist formation of a gap 517 between the post flange 513 and the fastener rim 515. In various embodiments, the fastener contact acts to press the fastener rim 515 against the post flange 513 such that actions that would open the gap 517 are resisted by resilient operation of the fastener contact.

In an alternative continuity bus fastener contact and bus front projection, fastener contact travel is extended. In particular, a collapsible portion 594 is incorporated in the fastener contact and bus front projection 592.

Figure 5B:
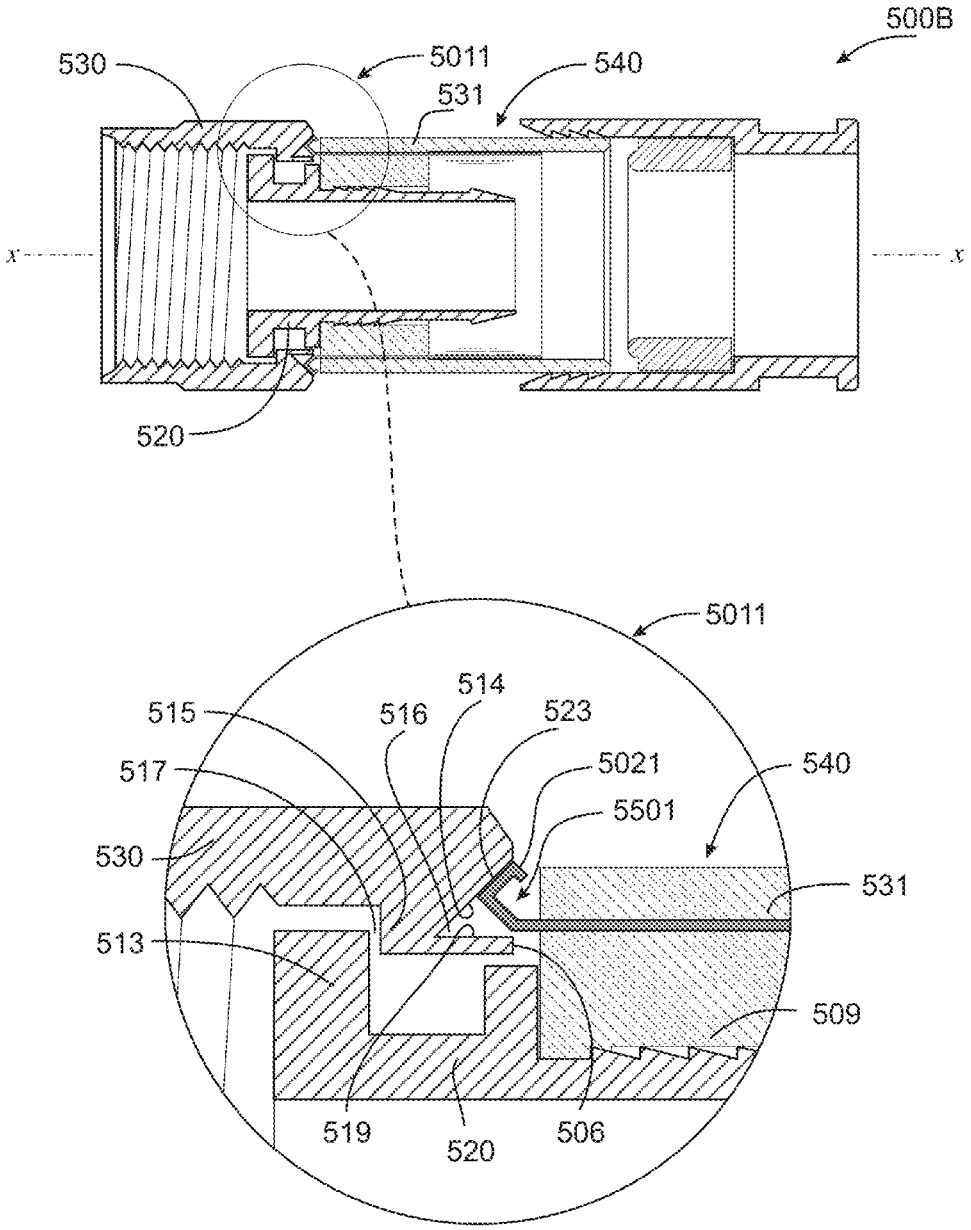

FIG. 5B shows a second continuity bus connector including a fastener groove 500B. The connector includes a post 520, a fastener 530 adjacent to a body 540 with a body peripheral wall 531, and is similar to the connector of FIG. 5A.

An enlarged connector portion 5011 shows the continuity bus of this connector 5501 is located in the body wall 531 such that a continuity bus fastener contact 5021 is exposed. As shown, the fastener contact is a portion of a front bus projection that is bent away from the connector centerline x-x to form a three segment arrow shaped fastener contact. The fastener contact is pointed into a fastener groove 516 encircling a back face 506 of the fastener. The fastener groove is generally "v" shaped and includes a floor 519 about parallel to the connector centerline and a sloped ceiling 514 that is angled away from the connector centerline.

When the connector of FIG. 5B is assembled, embodiments provide for contact and/or following contact between the fastener contact 5021 and the fastener groove 516. In particular, assembly of the connector causes contact between the fastener groove ceiling 514 and a segment 523 of the fastener contact 5021 that is parallel to the ceiling. This action tends to resist formation of a gap 517 between the post flange 513 and the fastener rim 515. In various embodiments, the fastener contact acts to press the fastener rim 515 against the post flange 513 such that actions that would open the gap 517 are resisted by resilient operation of the fastener contact.

Figure 5C:
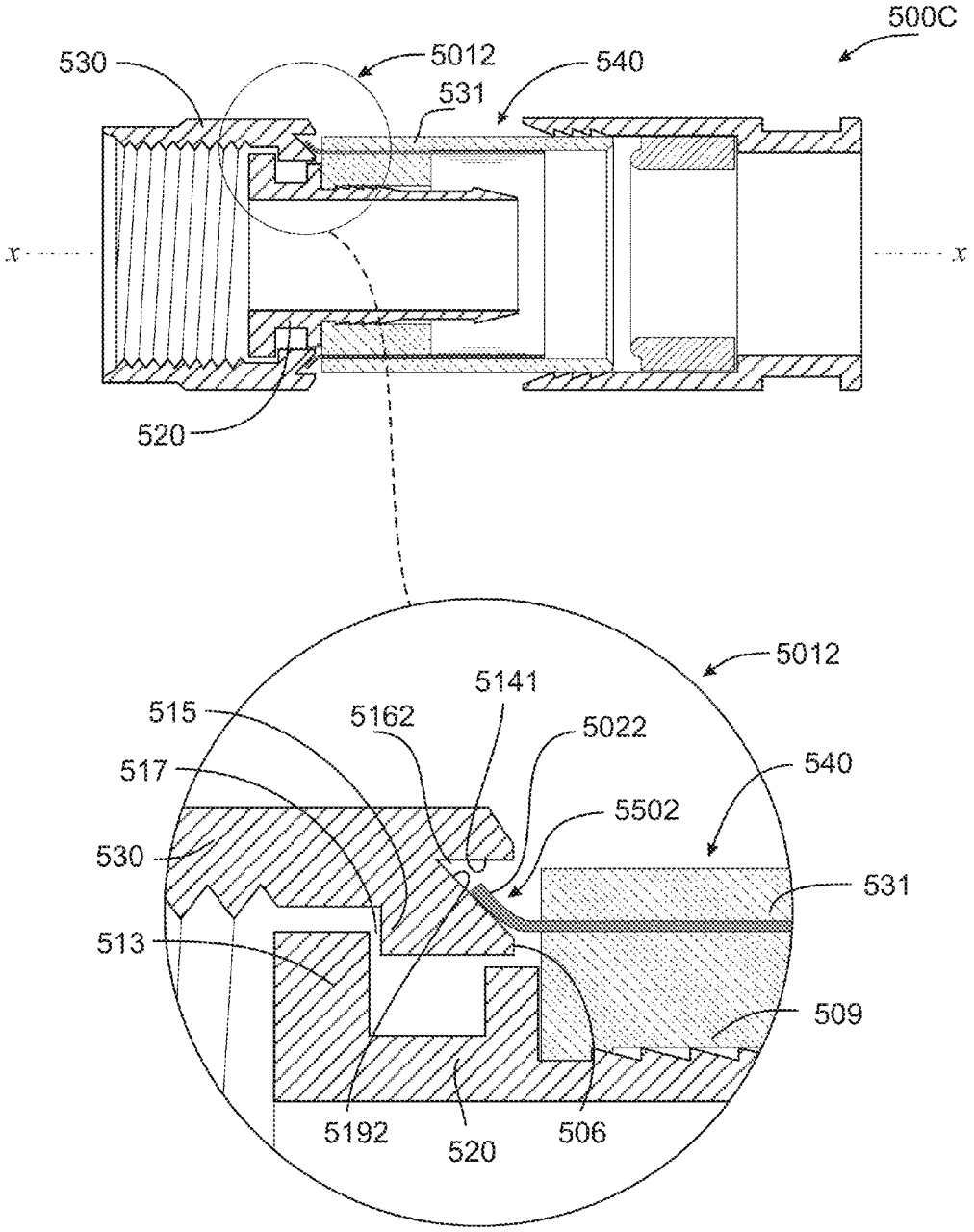

FIG. 5C shows a third continuity bus connector including a fastener groove 500C. The connector includes a post 520, a fastener 530 adjacent to a body 540 with a body peripheral wall 531, and is similar to the connector of FIG. 5A.

An enlarged connector portion 5012 shows the continuity bus of this connector 5502 is located in the body wall 531 such that a continuity bus fastener contact 5022 is exposed. As shown, the fastener contact is a portion of a front bus projection that is bent less than ninety degrees away from the connector centerline x-x to form a sloped wiper fastener contact. The fastener contact is inserted into a fastener groove 5162 encircling a back face 506 of the fastener. The fastener groove is generally "v" shaped and includes a floor 5192 sloped toward the connector centerline and a ceiling 5141 that is about parallel to the connector centerline.

When the connector of FIG. 5C is assembled, embodiments provide for contact and/or following contact between the fastener contact 5022 and the fastener groove 5162. In particular, assembly of the connector causes contact between the fastener groove floor 5192 and a fastener contact 5022. This action tends to resist formation of a gap 517 between the post flange 513 and the fastener rim 515. In various embodiments, the fastener contact acts to press the fastener rim 515 against the post flange 513 such that actions that would open the gap 517 are resisted by resilient operation of the fastener contact.

Figure 5D:
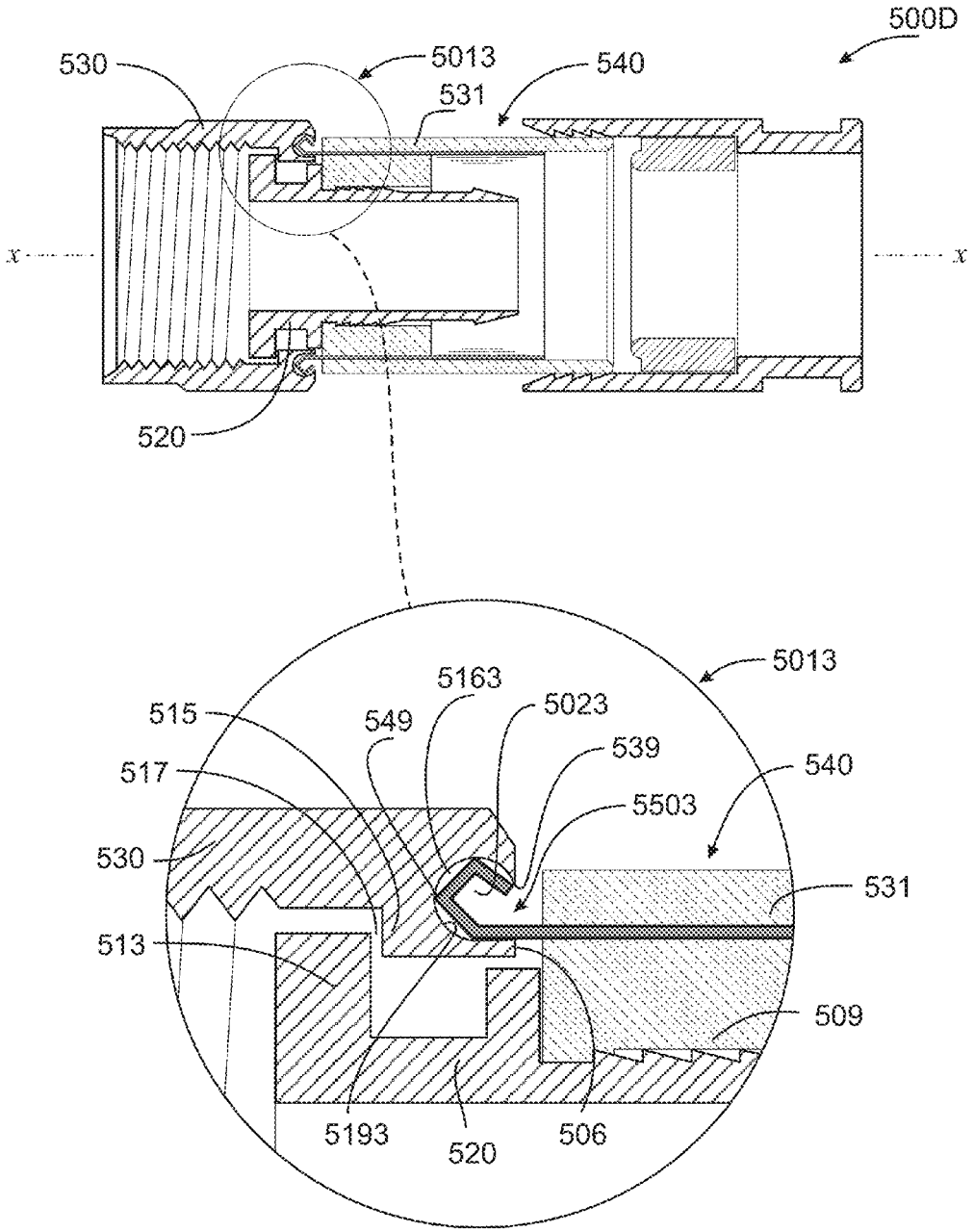

FIG. 5D shows a fourth continuity bus connector including a fastener groove 500D. The connector includes a post 520, a fastener 530 adjacent to a body 540 with a body peripheral wall 531, and is similar to the connector of FIG. 5A.

An enlarged connector portion 5013 shows the continuity bus of this connector 5503 is located in the body wall 531 such that a continuity bus fastener contact 5023 is exposed. As shown, the fastener contact is a portion of a front bus projection that is bent away from the connector centerline x-x to form a three segment arrow shaped fastener contact with three vertices (549 typical). The fastener contact is pointed into a fastener groove 5163 encircling a back face 506 of the fastener (See e.g. FIGS. 4A-D). The fastener groove is generally semi-cylindrically shaped and includes an interior groove wall 5193 defining a groove mouth 539. In various embodiments, the groove mouth is dimensioned such that the fastener contact is compressed when entering through the groove mouth and expanded after entry into the groove.

When the connector of FIG. 5D is assembled, embodiments provide for contact and/or following contact between the fastener contact 5023 and the fastener groove 5163. In particular, assembly of the connector causes contact between the fastener groove wall 5193 and vertices of the fastener contact 549 when the fastener contact is pushed through the groove mouth 539 and expands to contact the groove wall. This action tends to resist formation of a gap 517 between the post flange 513 and the fastener rim 515. In various embodiments, the fastener contact acts to press the fastener rim 515 against the post flange 513 such that actions that would open the gap 517 are resisted by resilient operation of the fastener contact.

As seen above, FIGS. 5A-D and the accompanying text describe various embodiments of the fastener and fastener contact configuration that include deformed end portions of the bus front projection.

Figure 5E:
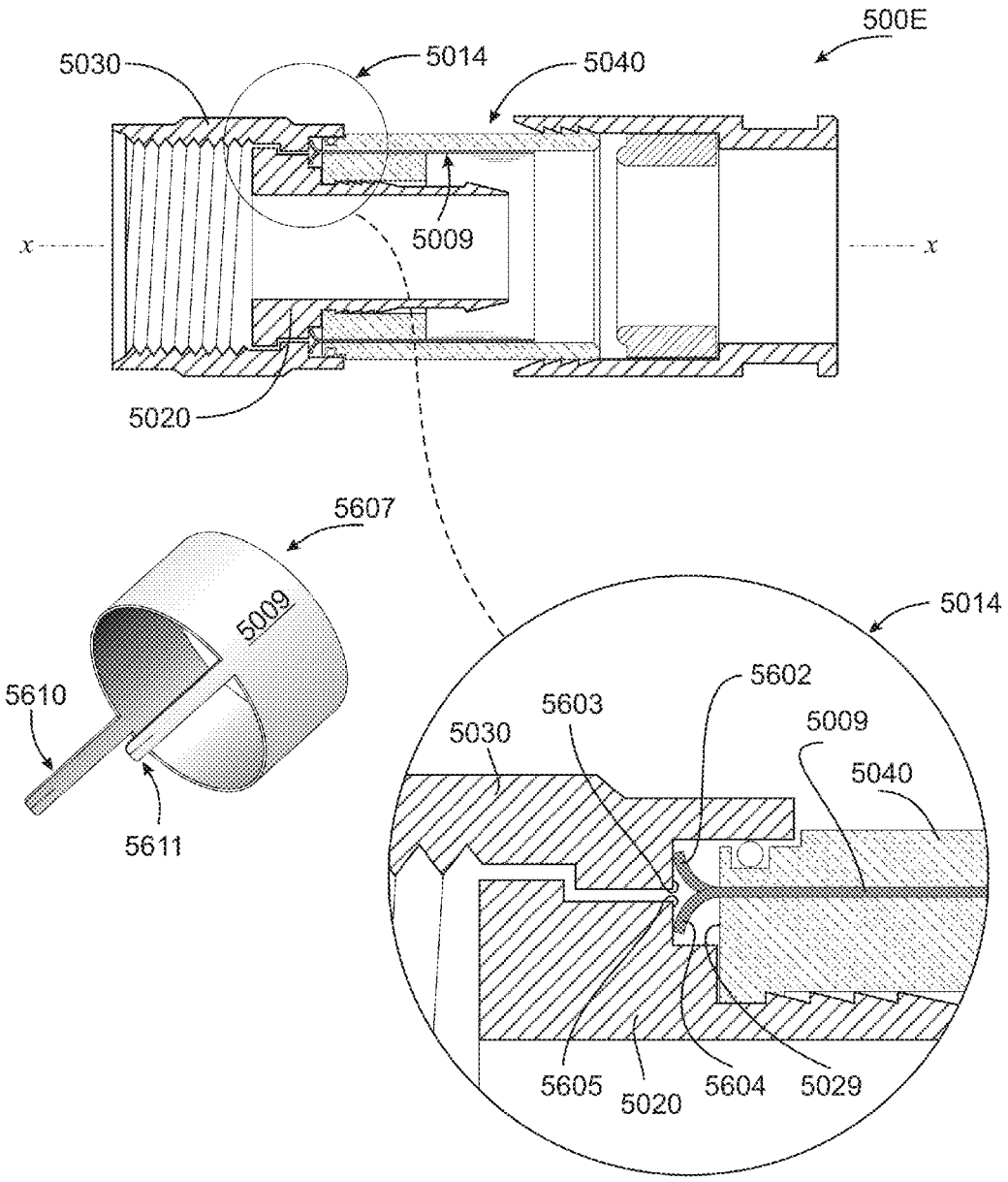
Figure 5F:
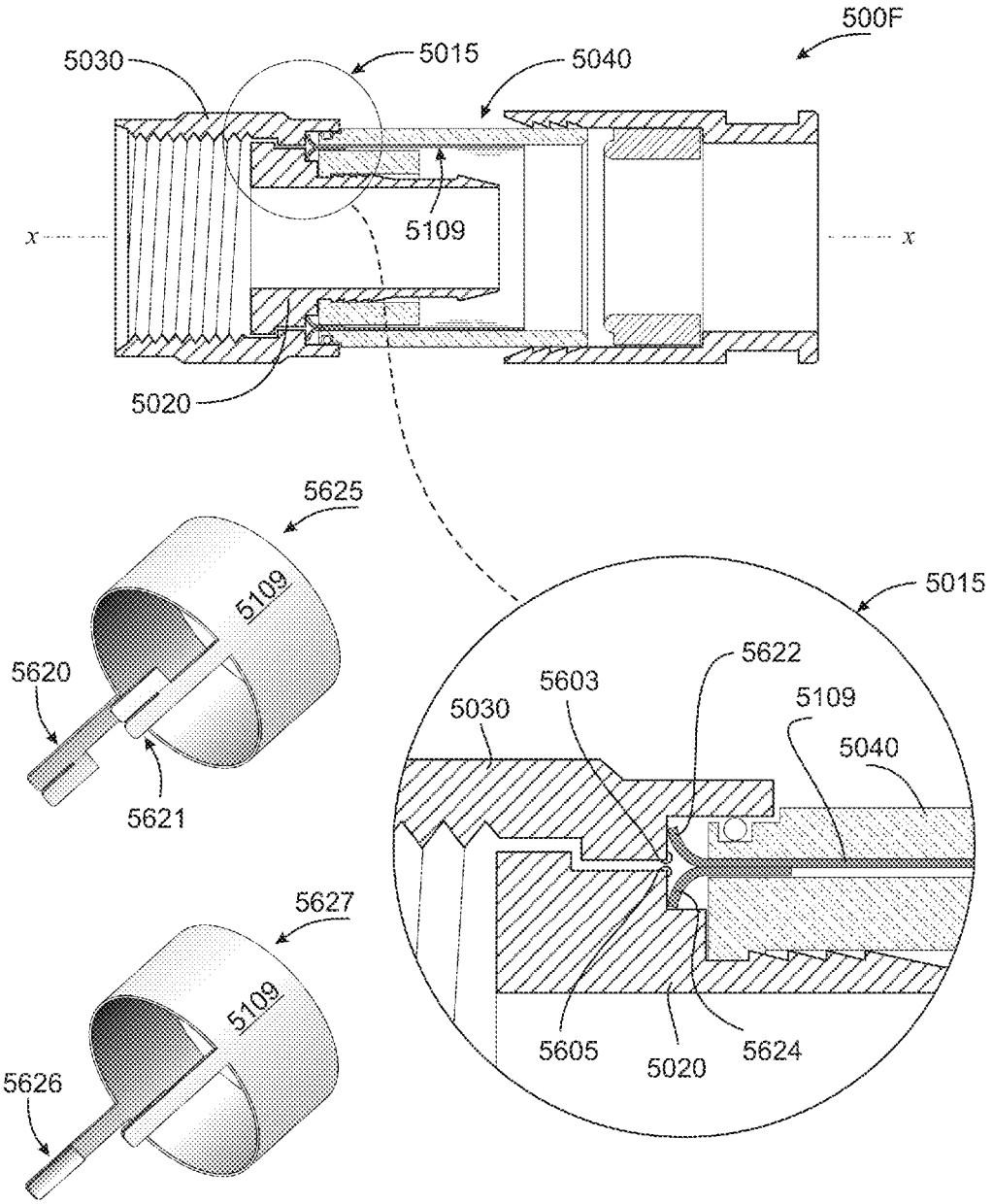

FIGS. 5E-F show connectors having split and/or multicontact bus fingers 500E-F.

FIG. 5E shows a connector similar to the connector of FIG. 3D insofar as a connector post 5020 engages a fastener 5030 and a body 5040, the body having a continuity bus 5009 inserted at least partially therein.

This connector 500E further includes a continuity bus 5009 with one or more continuity bus fingers 5610 and one or more of these fingers has a split and/or multicontact end such as that shown 5611, see e.g., the continuity bus perspective view 5607. As seen in the exploded fastener-post-body engagement zone 5014, a first split finger portion 5602 protrudes from an external body end wall 5029, is bent away from the connector longitudinal axis X-X, and is for bearing on and/or springingly engaging a nut such as a nut internal shoulder 5603. In similar fashion, a second split finger portion 5604 is bent toward the X-X axis and is for bearing on and/or springingly engaging a post such as a post external shoulder 5605. As will be understood by skilled artisans, ground continuity through this connector is enhanced by continuity bus contact with (i) the post, e.g. Path 4, and (ii) the fastener, e.g. Path 5.

FIG. 5F shows a connector similar to the connector of FIG. 5E.

This connector 500F includes a continuity bus 5109 with one or more continuity bus fingers 5620 and one or more of these fingers has a split, foldable end 5621, see e.g., a continuity bus perspective view 5625 with an unfolded end 5621 and a continuity bus perspective view 5627 with a folded end 5626. As seen in the exploded fastener-post-body engagement zone 5015, a first split finger portion 5622 is bent away from the connector longitudinal axis X-X and is for bearing on and/or springingly engaging a nut internal shoulder 5603. In similar fashion, a second split finger portion 5624 is bent toward the X-X axis and is for bearing on and/or springingly engaging a post external shoulder 5605. As will be understood by skilled artisans, ground continuity through this connector is enhanced by continuity bus contact with (i) the post, e.g. Path 4, and (ii) the fastener, e.g. Path 5.

Figure 5G:
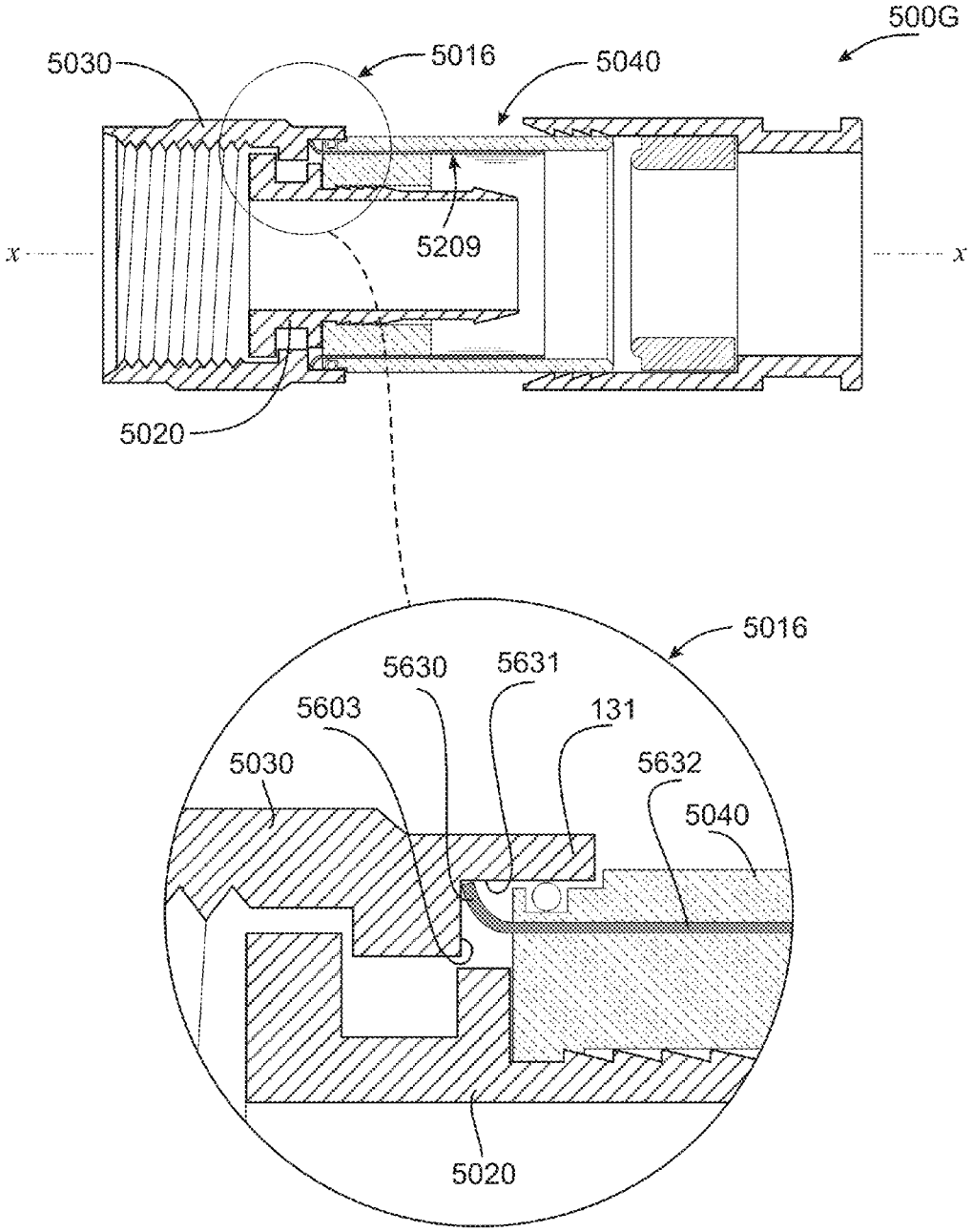
Figure 5H:
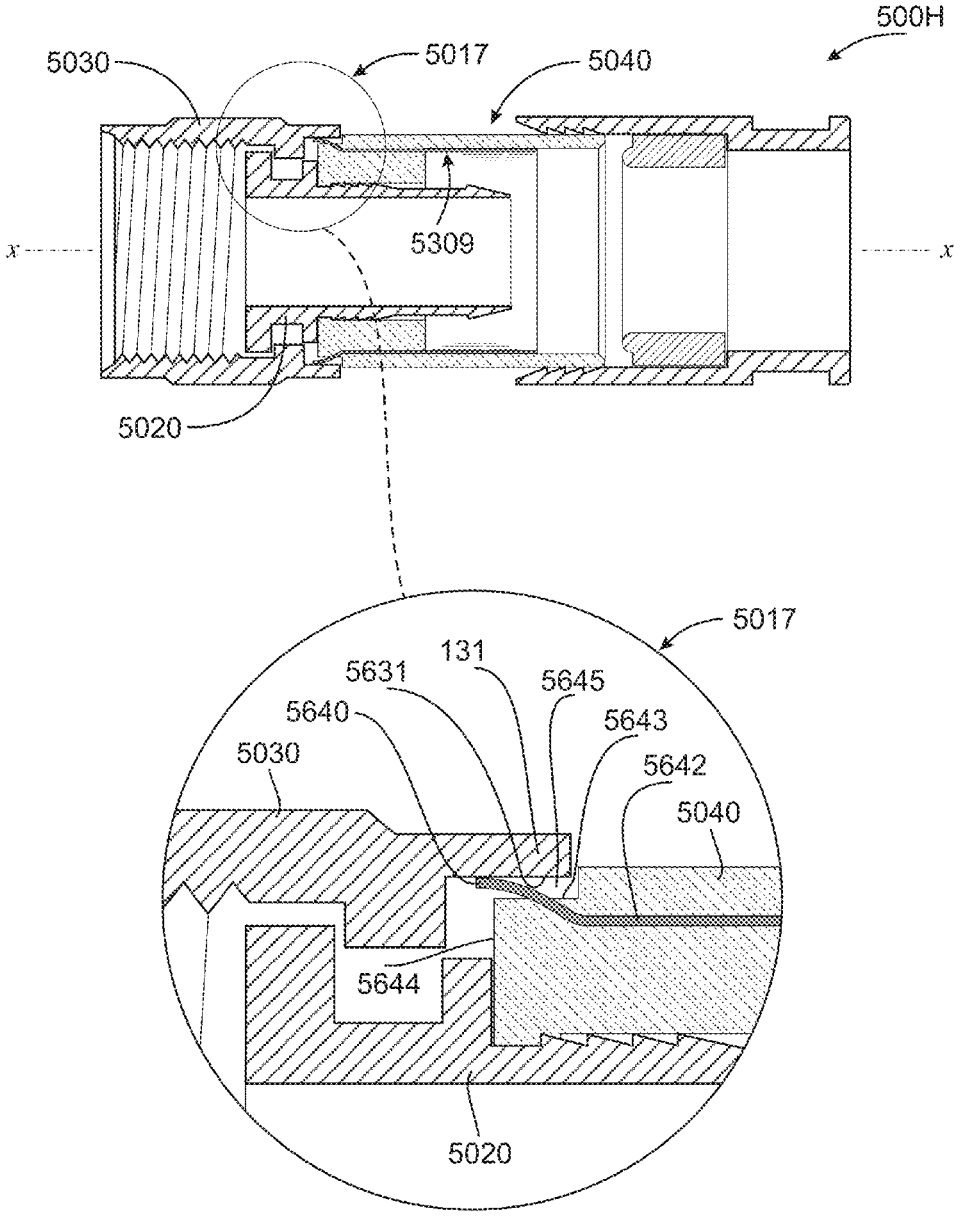
Figure 5I:
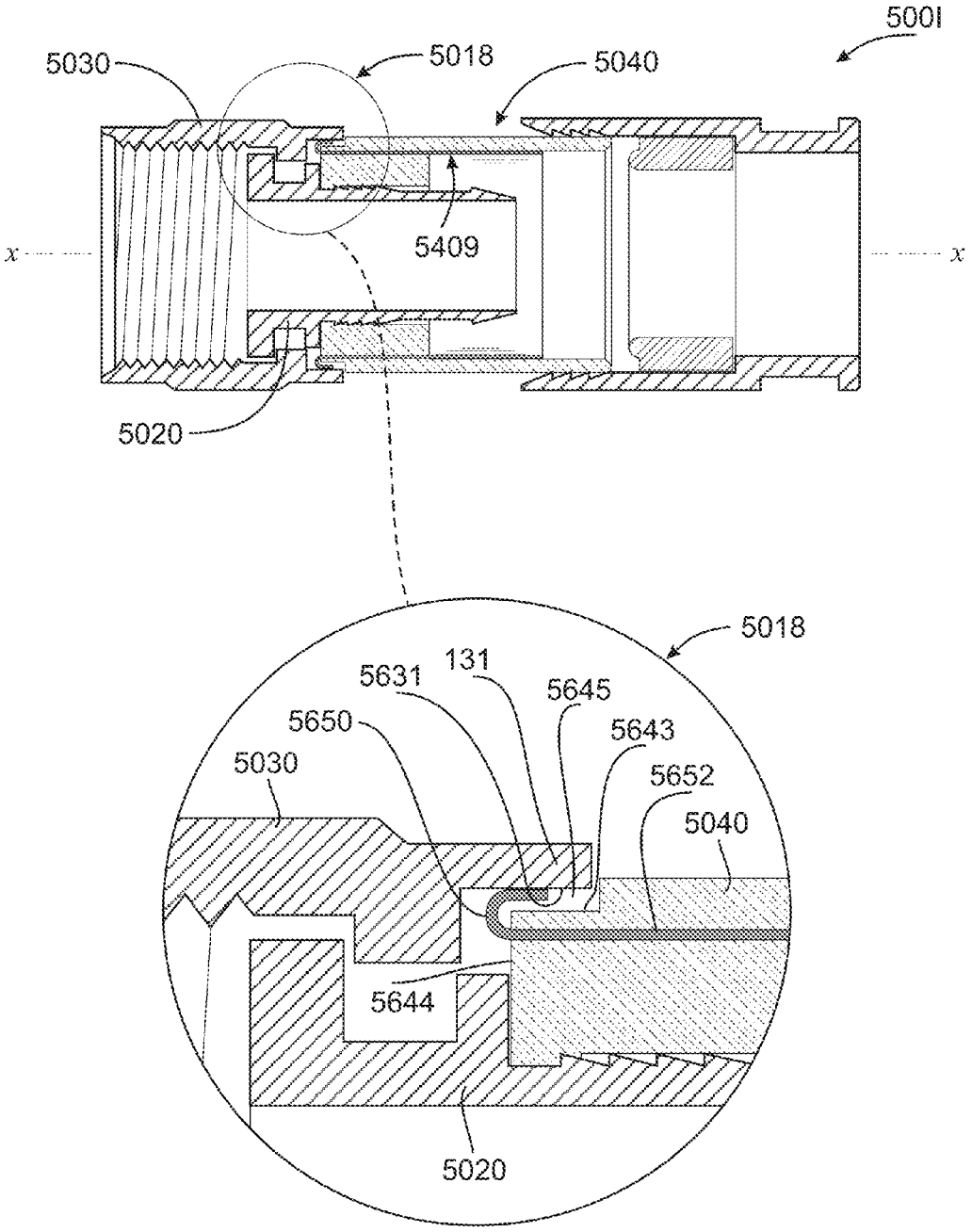

FIGS. 5G-I show connectors having radially contacting bus fingers 500G-I.

FIG. 5G shows a connector similar to the connector of FIG. 3D insofar as a connector post 5020 engages a fastener or nut 5030 and a body 5040, the body having a continuity bus 5209 inserted at least partially therein.

This connector 500G further includes one or more continuity bus fingers 5632 with ends 5630 bent away from the connector centerline X-X. As seen in the exploded zone 5016, the bus finger end(s) 5630 are shaped to radially contact an inner cylinder-like surface 5631 of the nut 5030 rim 131. In some embodiments, the bent end contacts one or both of the adjacent nut surfaces 5603, 5631. As shown, the continuity bus 5209 has a substantially constant inside diameter throughout its length. And, as skilled artisans will appreciate, ground continuity through this connector is enhanced by continuity bus contact with the fastener 5030, see e.g. Paths 3, 5.

FIG. 5H shows a connector similar to the connector of FIG. 5G. Again, a finger 5642 end 5640 of a continuity bus 5309 radially contacts an inner surface 5631 of the nut rim 131. However, as seen in the exploded zone 5017 the finger end 5640 does not protrude from the body end as in FIG. 5G. Rather, the finger end protrudes from a body shoulder such as an external shoulder or sidewall 5643 into a cavity 5645 between the body shoulder and the nut rim 131. As seen the shoulder is about perpendicular to an end 5644 of the body 5040. In various embodiments, the finger end angles away from the connector axis X-X in order to leave the connector body via the shoulder. And, as skilled artisans will appreciate, ground continuity through this connector is enhanced by continuity bus contact with the fastener 5030, see e.g. Paths 3, 5.

FIG. 5I shows a connector similar to the connector of FIG. 5G. Again, a finger 5652 end 5650 of a continuity bus 5409 radially contacts an inner surface 5631 of the nut rim 131. As seen in the exploded zone 5018, the finger end 5650 protrudes from a body end such as a body end wall 5644, curves away from the connector axis X-X and into a cavity 5645 between the nut rim 131 and an opposed shoulder 5643 of the body 5040. As shown, the continuity bus is formed to point toward an end of the connector body that is opposite the end from which it protrudes. This hook-like feature of the finger end provides for the radial contact between the finger end and the inside surface 5631 of the rim. And, as skilled artisans will appreciate, ground continuity through this connector is enhanced by continuity bus contact with the fastener 5030, see e.g. Paths 3, 5.

Figure 5J:
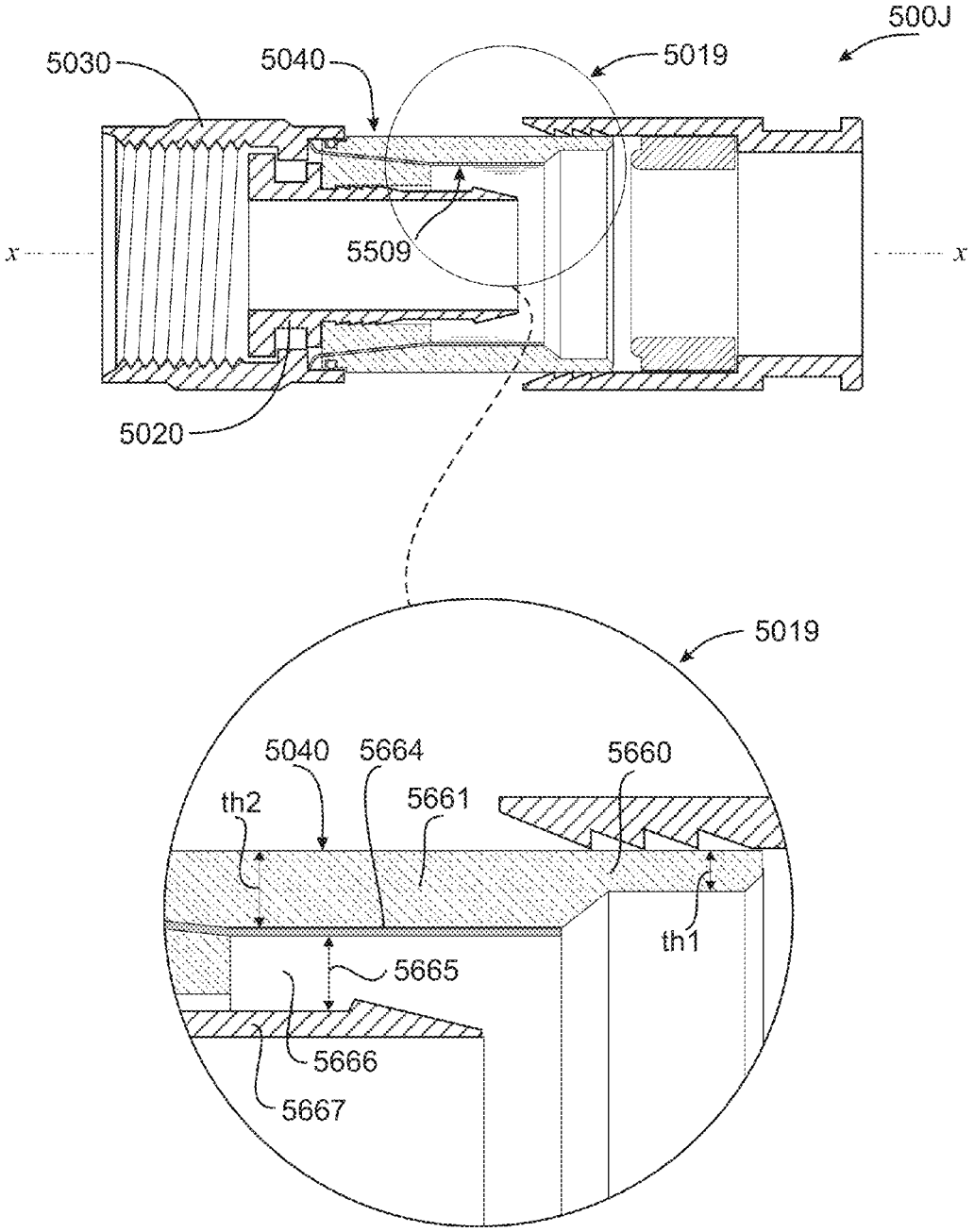

FIG. 5J shows a connector for use with reduced diameter coaxial cables 500J.

The connector of FIG. 5J is similar to the connector of FIG. 3D. However, as seen in the exploded zone 5019, the connector 500J provides for a reduced gap 5665 between the body interior 5664 and a trailing post portion 5667. As seen, the thickness "th1" of a trailing body portion 5660 is less than the thickness "th2" of an adjoining body portion 5661 such that a gap 5665 associated with a coaxial cable receiving cavity 5666 is reduced to accommodate reduced diameter coaxial cables such as a reduced diameter tri-shield coaxial cable, for example a tri-shield RG 6 cable. In some embodiments, th2 is chosen such that the inside diameter of the body is approximately 7.38 mm plus or minus 0.2 mm. And, in some embodiments, th2 is chosen such that the inside diameter of the body is approximately (7.1 mm+clearance) where clearance ranges from 0.1 to 0.7 mm.

Figure 5K:
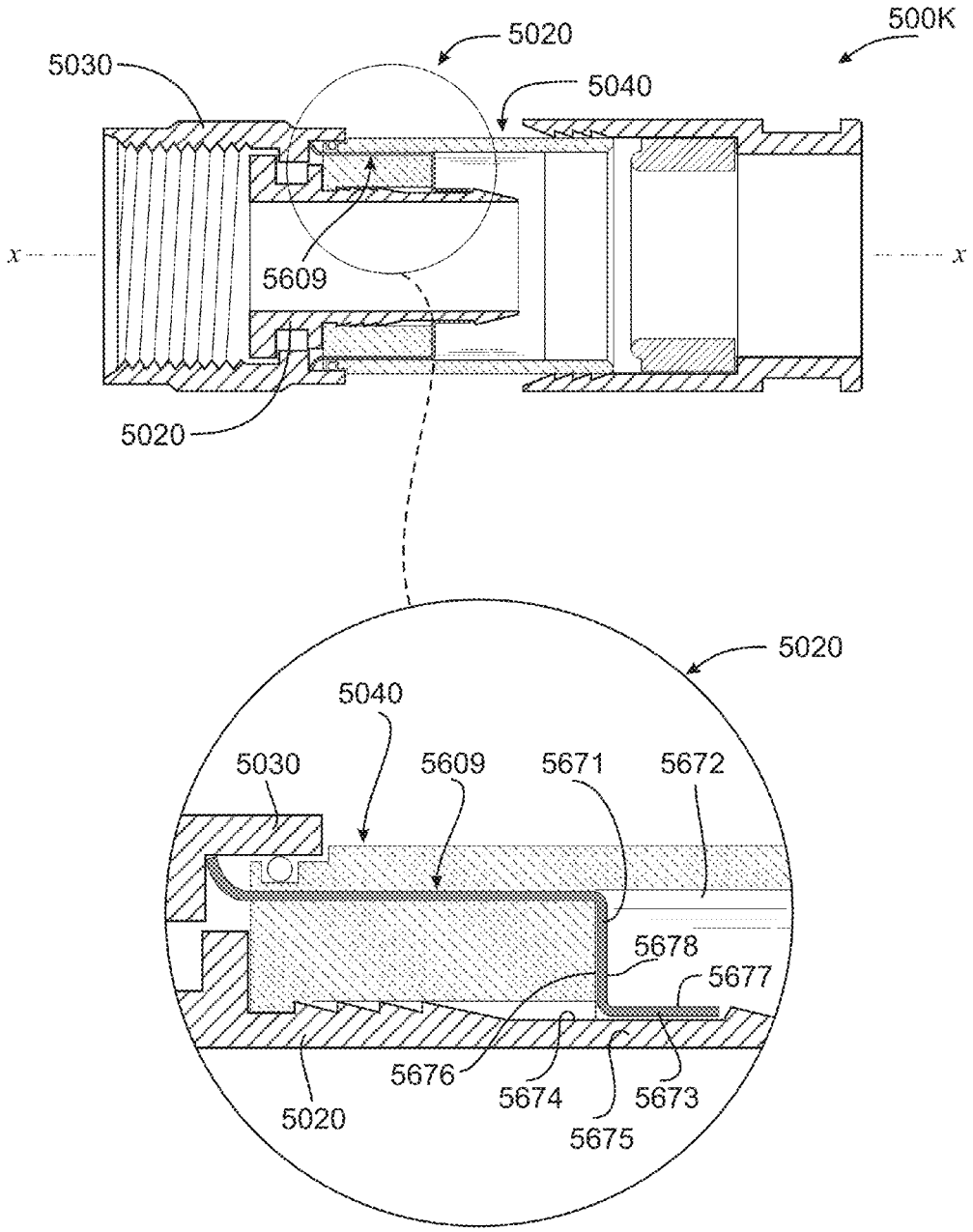
Figure 5L:
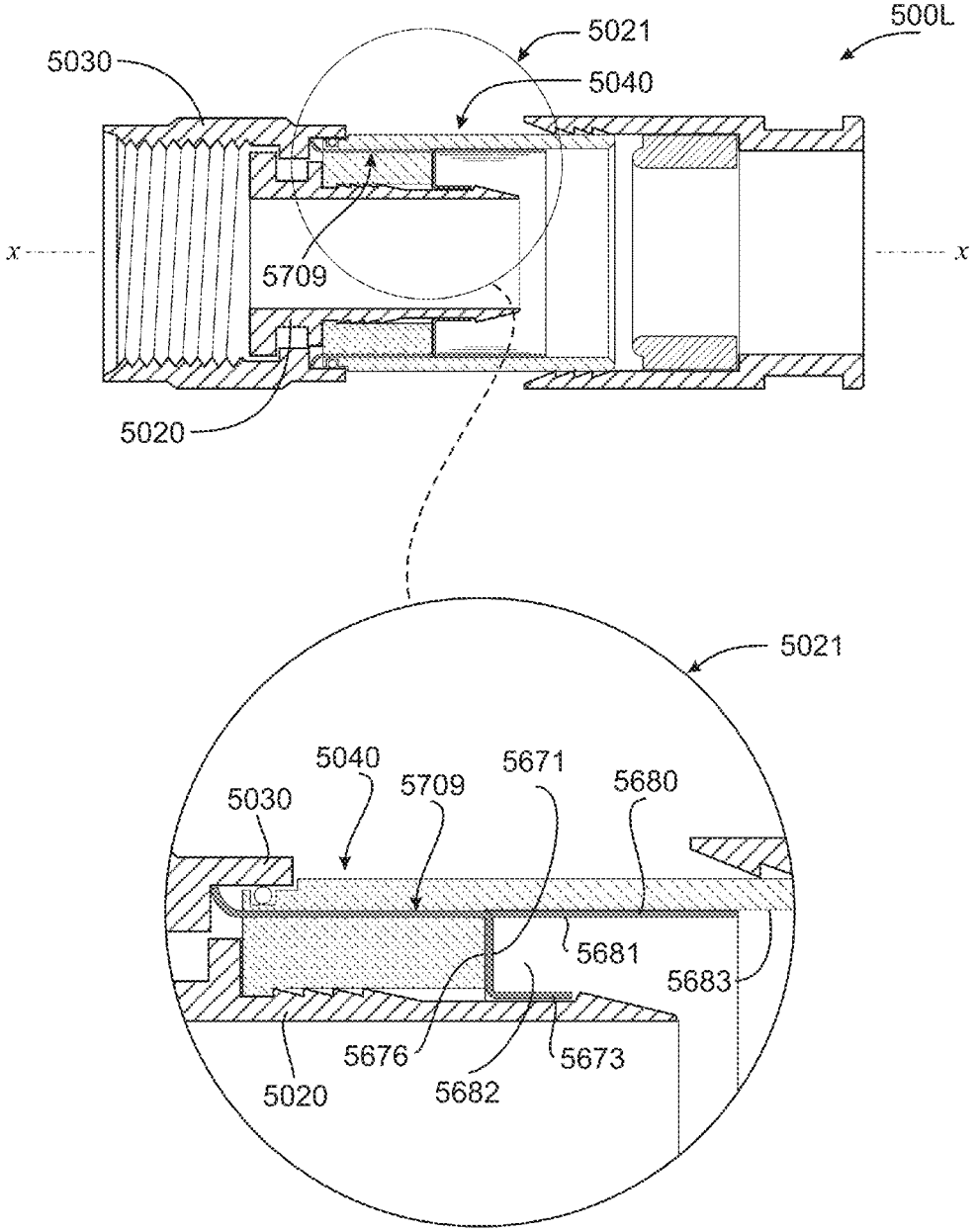

FIGS. 5K-L show connectors with a post contacting continuity bus 500K-L.

The connector of FIG. 5K is similar to the connector of FIG. 5G. However, as seen in the exploded zone 5020 the connector 500K includes a continuity bus 5609 having a central portion 5671 and an adjoining trailing portion 5673 that lies along 5674 a trailing portion of the post 5675. In particular, the connector includes a coaxial cable receiving space 5672 that is at least partially enclosed by the trailing post portion and the body 5040. The continuity bus protrudes from a body rear shoulder or internal body end wall 5676 perpendicular to the X-X axis, extends along the shoulder toward the connector axis X-X, and then along the post trailing portion. As such, the continuity bus has a first surface 5678 perpendicular to the X-X axis and a second surface 5677 parallel to the X-X axis and these surfaces bound portions of the coaxial cable receiving cavity 5672. Skilled artisans will appreciate that insertion of a cable into the cavity results in portions of the turned back cable braid (see e.g., FIG. 1B) contacting the first and/or the second contact bus surfaces.

The connector of FIG. 5L is similar to the connector of FIG. 5K. However, as seen in the exploded zone 5021 the connector 500L includes a continuity bus 5709 portion 5680 that extends along an inside surface of a body portion 5683 extending from the body rear shoulder 5676. As such, the continuity bus has a third surface 5681 bounding a cable receiving zone 5682 and facing the X-X axis. Skilled artisans will appreciate that insertion of a cable into the cavity results in portions of the turned back cable braid (see e.g., FIG. 1B) contacting one or more of these first, second and third continuity bus surfaces.

Figure 5M:
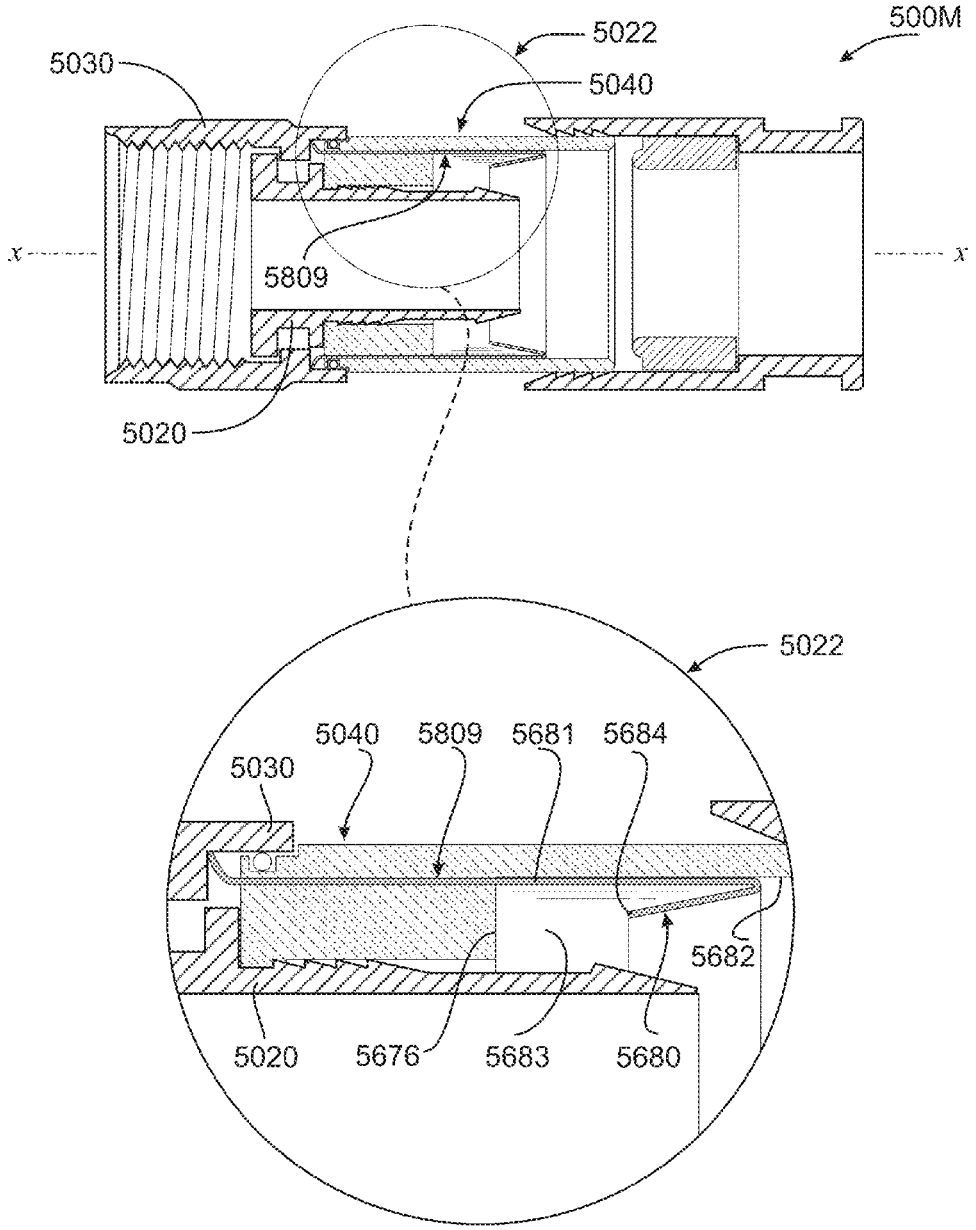

FIGS. 5M-AD show connectors with a rearwardly deforming continuity bus portion 500M-AD. In at least some embodiments, the deforming portions springingly engage the coaxial cable and/or its outer braid. Embodiments include continuity buses with cylinder-like trailing portions, some of which are shown in perspective views. It should be noted that deforming sections of the continuity bus may have features such as local thinning, serrations, fold lines, and the like to ease deformation and/or to guide the lines along which deformation takes place.

The connector of FIG. 5M is similar to the connector of FIG. 5G. However, as seen in the exploded zone 5022, the connector 500M includes a rearward continuity bus portion 5680 that deforms when a coaxial cable is inserted in the connector cable receiving zone 5683. In particular, the continuity bus 5809 extends 5681 from a body rear shoulder 5676 along an inside wall 5682 of the body 5040 and terminates with a "hook" like feature 5680 with an end 5684 that points back toward the body rear shoulder. Applicant notes that end 5684 refers here, as seen in the figure, to a tip of the continuity bus. Skilled artisans will appreciate that insertion of a cable past the hook causes turned back cable braid to press against the hook and tends to deform the hook by pressing its end 5684 away from the post 5020 and toward the body.

Figure 5N:
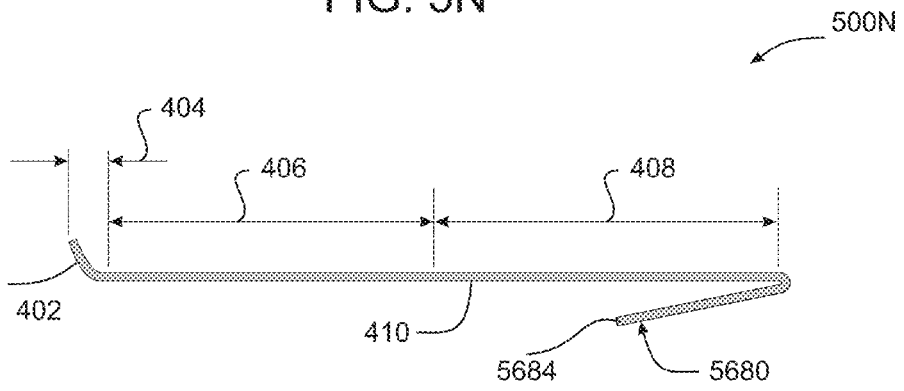
Figure 5O:
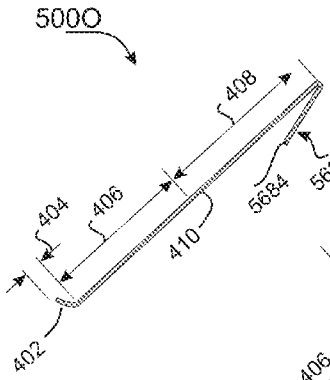
Figure 5P:
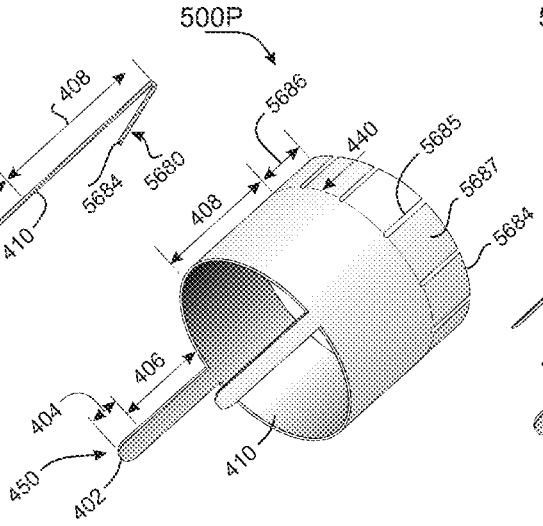
Figure 5Q:
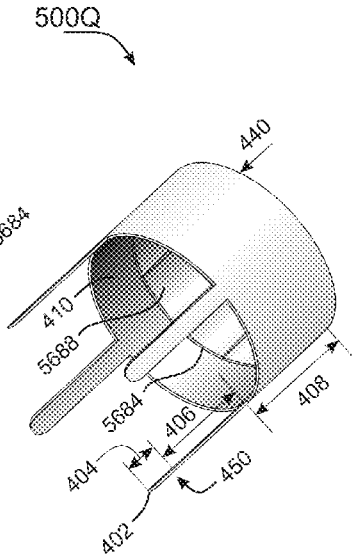

FIGS. 5N-Q show an embodiment 500N-500Q of the continuity bus of FIG. 5M. This continuity bus is similar to the continuity bus of FIG. 4A and, as such, the nomenclature of FIGS. 4A-D is repeated. However, the continuity bus of 500N-500Q includes a hook 5680. In FIG. 5N, the hook 5680 is shown along with its end 5684. In FIG. 5O, a perspective cross-section including the hook 5680 is shown. In FIG. 5P, a perspective view of the continuity bus 500P is shown before the hook is formed. In particular, a trailing somewhat cylindrical portion of the continuity bus 5686 illustrates slots 5685 that enable folding of sections or tabs 5687 to form the hooks. In FIG. 5Q, a perspective view of the continuity bus 500Q is shown after the hook is formed. Here, the folded tabs 5688 form hooks similar to the hooks 5680 of FIG. 5M.

Figure 5R:
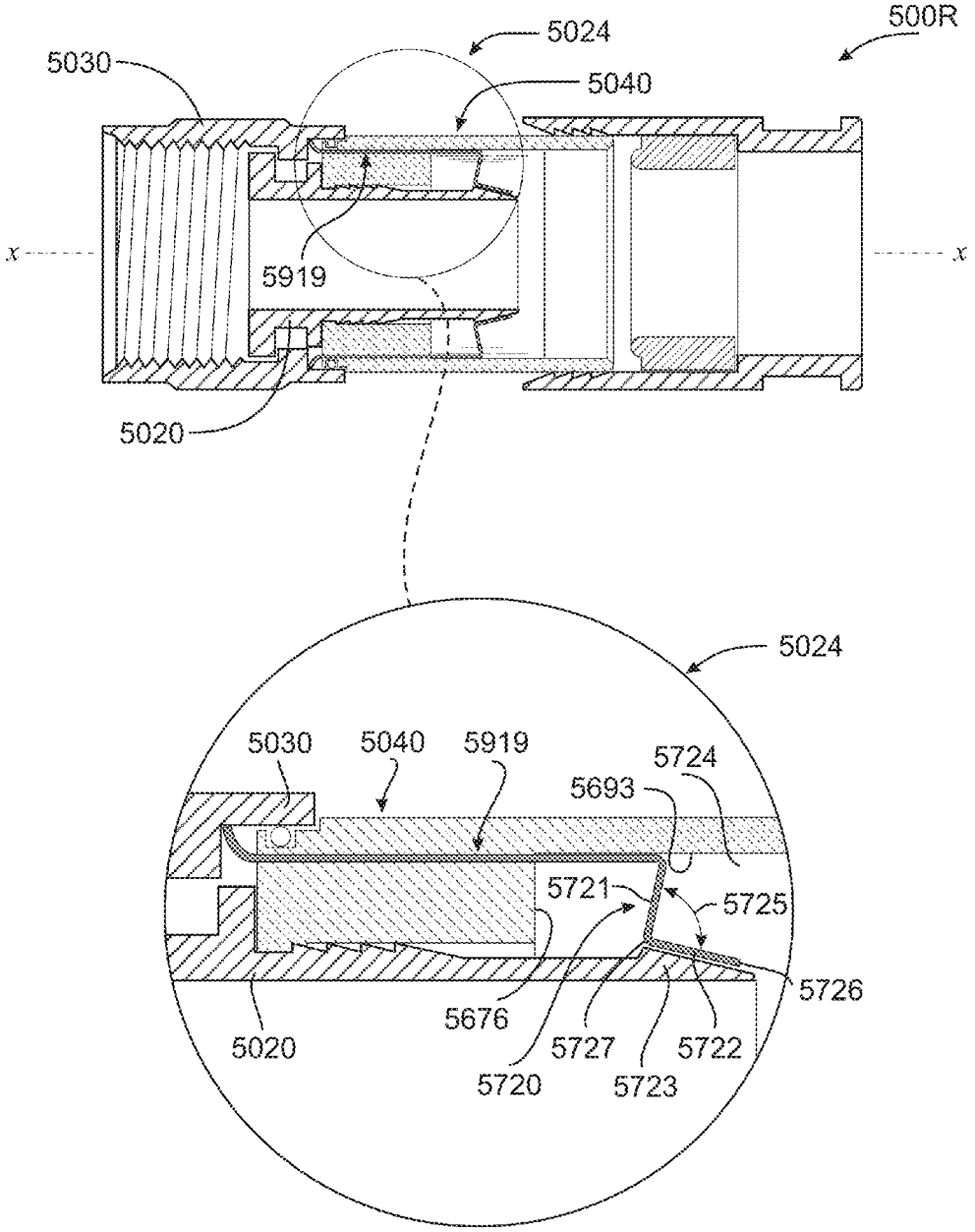

The connector of FIG. 5R is similar to the connector of FIG. 5G. However, as seen in the exploded zone 5024, connector 500R includes a rearward continuity bus portion 5720 that deforms when a coaxial cable is inserted in the connector cable receiving zone 5724. In particular, the continuity bus 5919 extends from a body rear shoulder 5676 along an inside wall 5693 of the body 5040 and terminates with a pinching or crimping feature 5720. A bend such as an "Z" bend in the continuity bus provides a flap 5722 at the end of the continuity bus that lies along a post barb 5723 exterior. The pincer 5720 end 5726 is for engagement with a coaxial cable that is inserted into the coaxial cable receiving zone. In particular, the pincer end and post barb insert beneath turned back coaxial cable braid (see e.g., FIG. 1B) such that further advancement of the cable into the connector tends to force a pincer vertex 5727 toward the fastener 5030 while reducing the pincer angle 5725 in a pinching or crimping action that captures the braid between the pincer flap 5722 and an adjoining pincer section 5721.

Figure 5S:
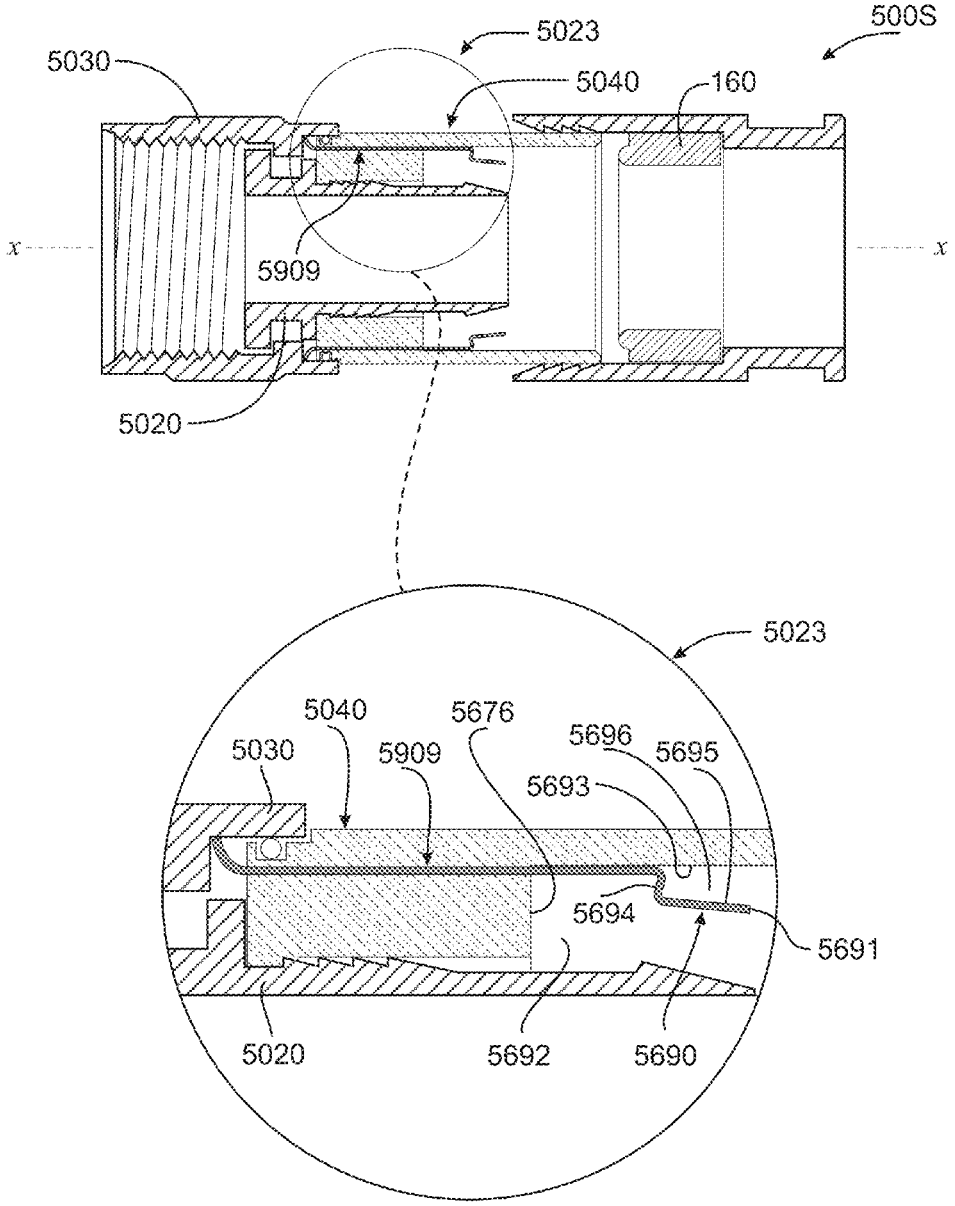

The connector of FIG. 5S is similar to the connector of FIG. 5G. However, as seen in the exploded zone 5023, the connector 500S includes a rearward continuity bus portion 5690 with end or tip 5691. The rearward bus portion deforms when a coaxial cable is inserted in the connector cable receiving zone 5692. In particular, the continuity bus 5909 extends from a body rear shoulder 5676 along an inside wall 5693 of the body 5040 and terminates with a pinching or crimping feature 5690. A bend such as an "Z" bend in the continuity bus 5694 provides a flap 5695 at the end of the continuity bus that is free to move in a gap 5696 between the flap and the body 5040. As is further described below, the pincer is engageable near its end 5691 by a deformable ring 160 that moves with an enveloping connector rear shell 150 encircling the body.

Figure 5T:
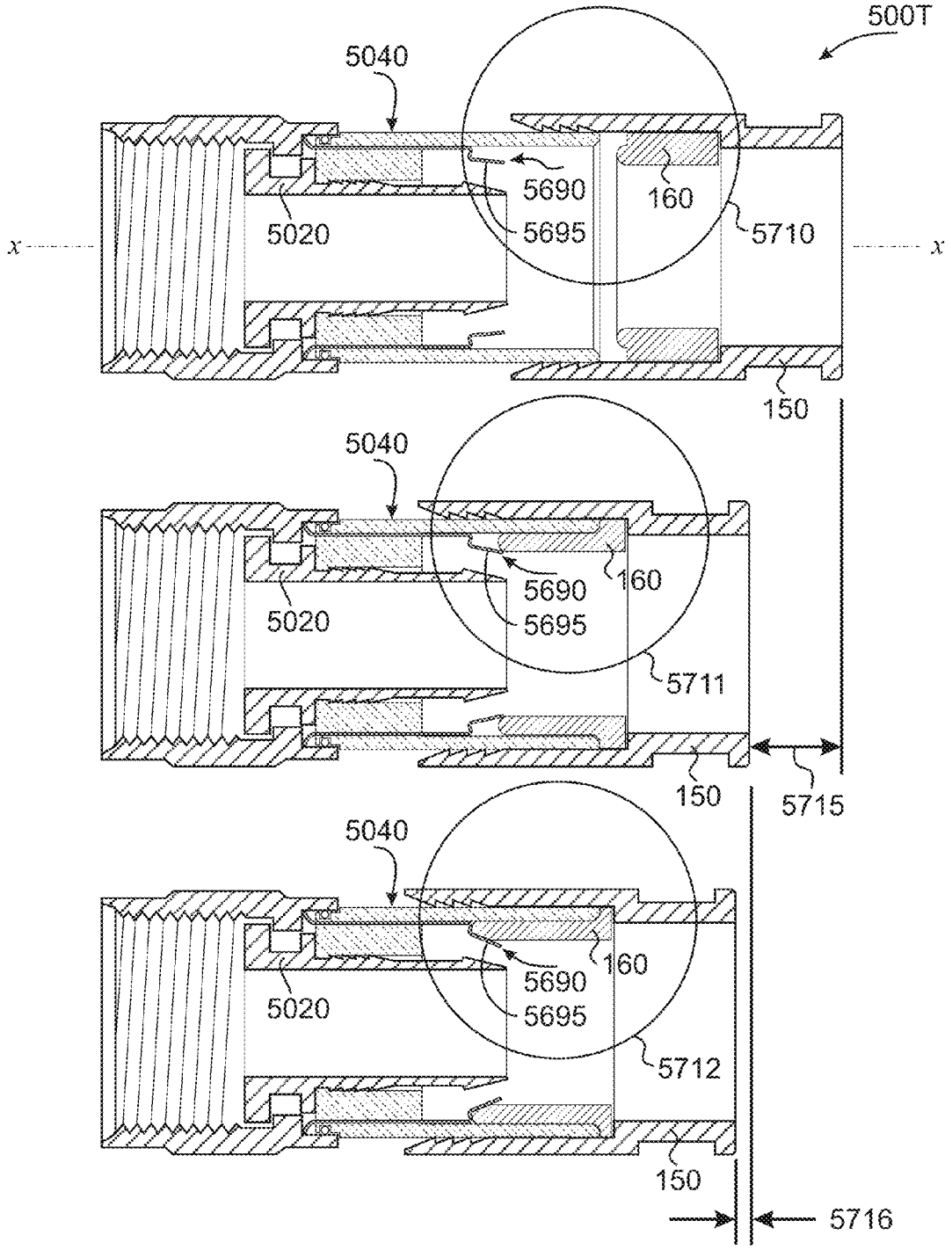

FIG. 5T shows the connector 500T of FIG. 5S before and during pincer/ring engagement. In a first position 5710 prior to advancement of the rear shell 150 onto the body 5040, the pincer 5690 and deformable ring 160 are not in contact. In a second position 5711 after a first advancement 5715 of the rear shell onto the body, the pincer and deformable ring are in contact. In a third position 5712 after a second advancement 5716 of the rear shell onto the body, the deformable ring pushes the pincer flap 5695 toward the post 5020. While the coaxial cable with its turned back braid has not been shown for clarity, skilled artisans will appreciate coordinated action of the pincer and the deformable ring pinch the coaxial cable braid between the pincer and the post, for example between the pincer flap and a post end such as a barbed end of the post.

Figure 5U:
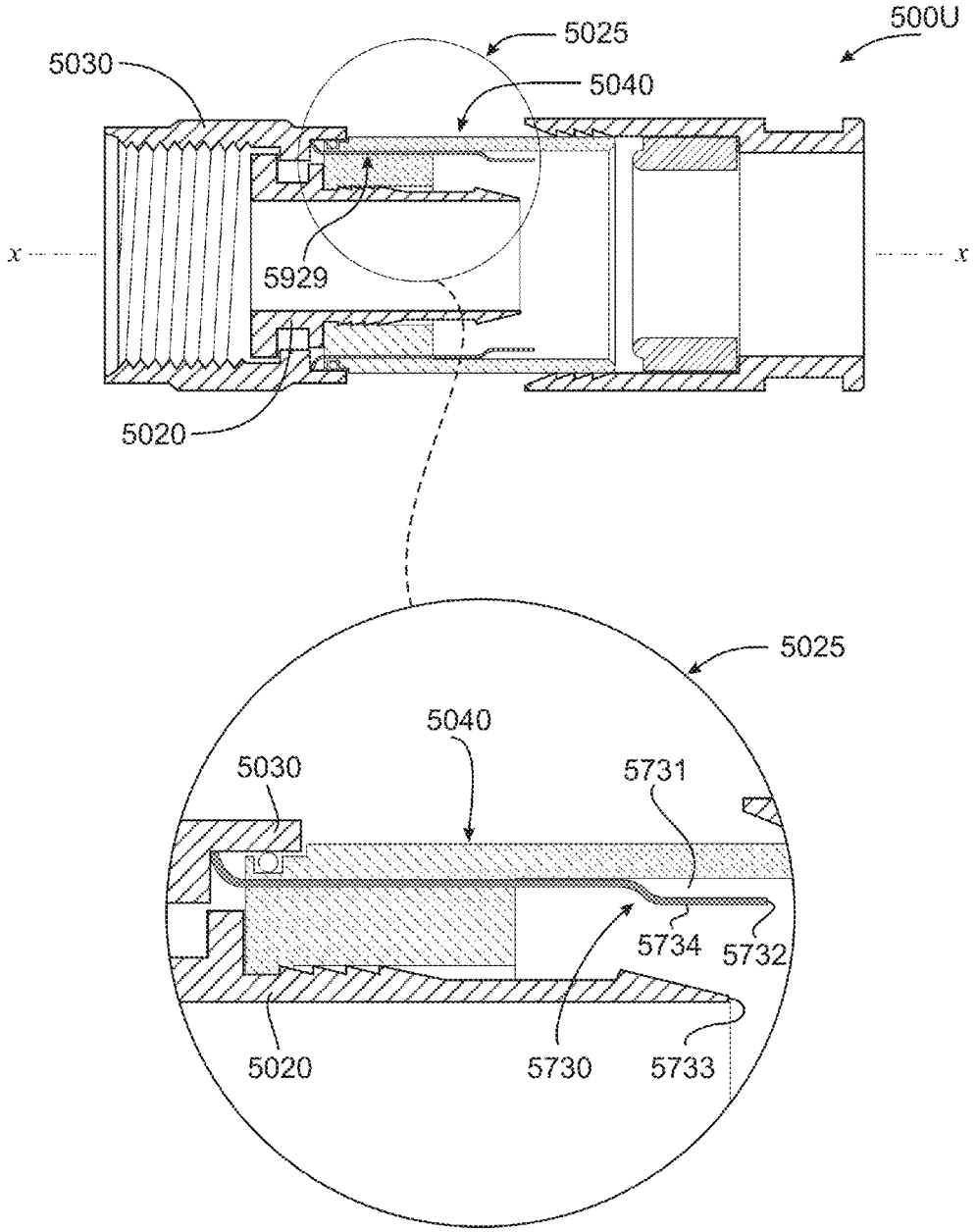

The connector 500U of FIG. 5U is similar to the connector of FIG. 5S. However, as seen in the exploded zone 5025, a continuity bus 5929 includes a rearward continuity bus portion 5730 having an end 5732 that extends longitudinally along connector axis X-X beyond the post barb tip 5733 and the gap 5731 between the pincer flap 5734 and the body 5040 is substantially constant as compared with the varying gap 5696 of the connector of FIG. 5S.

Figure 5V:
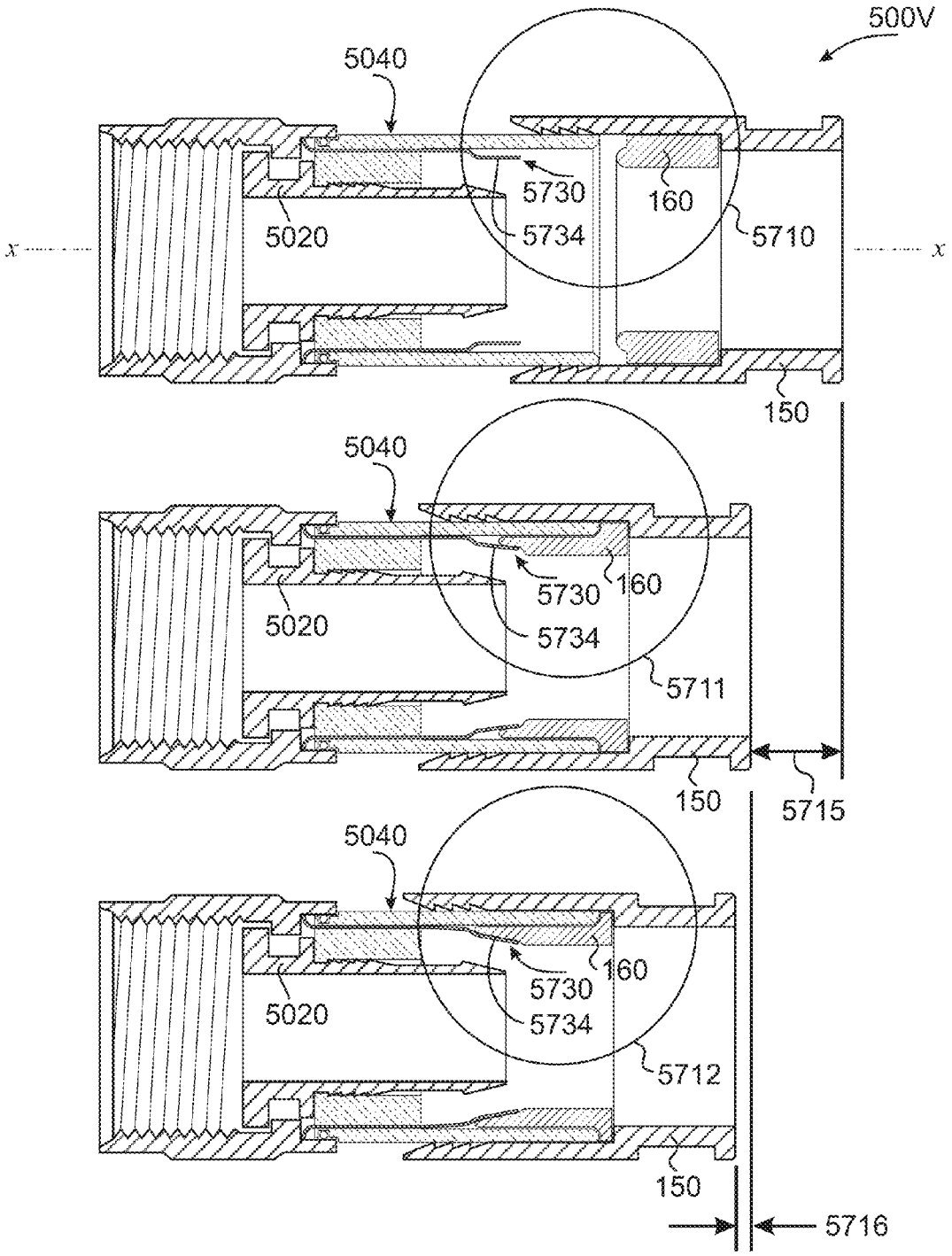

FIG. 5V shows the connector 500V of FIG. 5U before and during pincer/ring engagement. In a first position 5710 prior to advancement of the rear shell 150 onto the body 5040, the pincer 5730 and deformable ring 160 are not in contact. In a second position 5711 after a first advancement 5715 of the rear shell onto the body, the pincer and deformable ring are in contact. In a third position 5712 after a second advancement 5716 of the rear shell onto the body, the deformable ring pushes the pincer flap 5734 toward the post 5020. While the coaxial cable with its turned back braid has not been shown for clarity, skilled artisans will appreciate coordinated action of the pincer and the deformable ring pinch the coaxial cable braid between the pincer and the post, for example between the pincer flap and a post end such as a barbed end of the post.

Figure 5W:
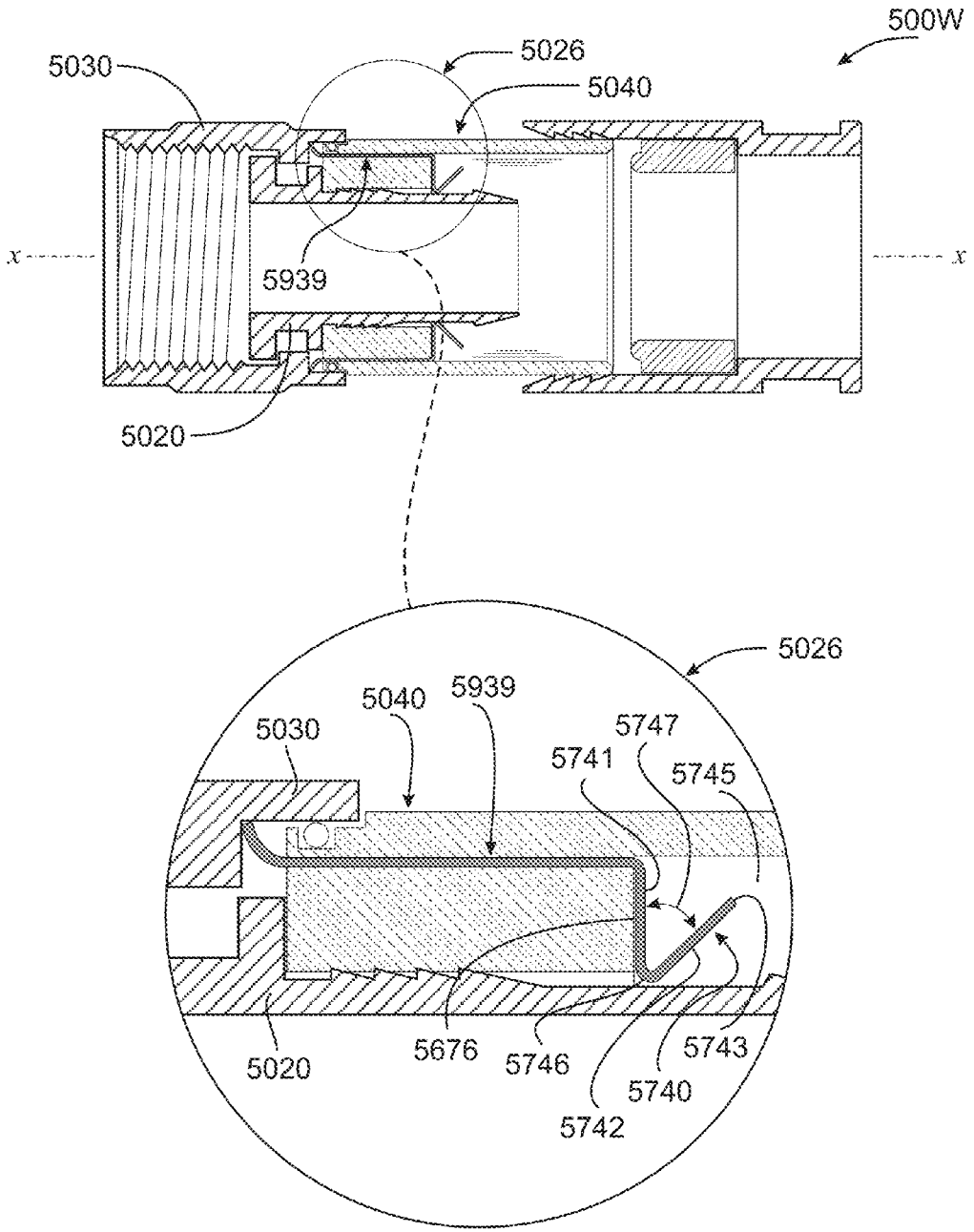

The connector of FIG. 5W is similar to the connector of FIG. 5G. However, as seen in the exploded zone 5026, the connector 500W includes a continuity bus 5939 with a rearward continuity bus portion 5740 that deforms when a coaxial cable is inserted in the connector cable receiving zone 5745. In particular, the rearward bus portion 5740 protrudes from a body rear shoulder 5676, has a first section 5741 along the shoulder 5676 and perpendicular to the connector axis X-X, and a second section 5742 angled away from the first section such that its end 5743 is pointed toward the body. The first and second sections are separated by an angle 5747 with an angle vertex 5746 where the sections join such as at a bend in the rearward bus portion. Insertion of a coaxial cable into the cable receiving zone 5745 brings the cable braid into contact with the second section 5742. In various embodiments, the second section 5740 springingly engages the cable braid.

Figure 5X:
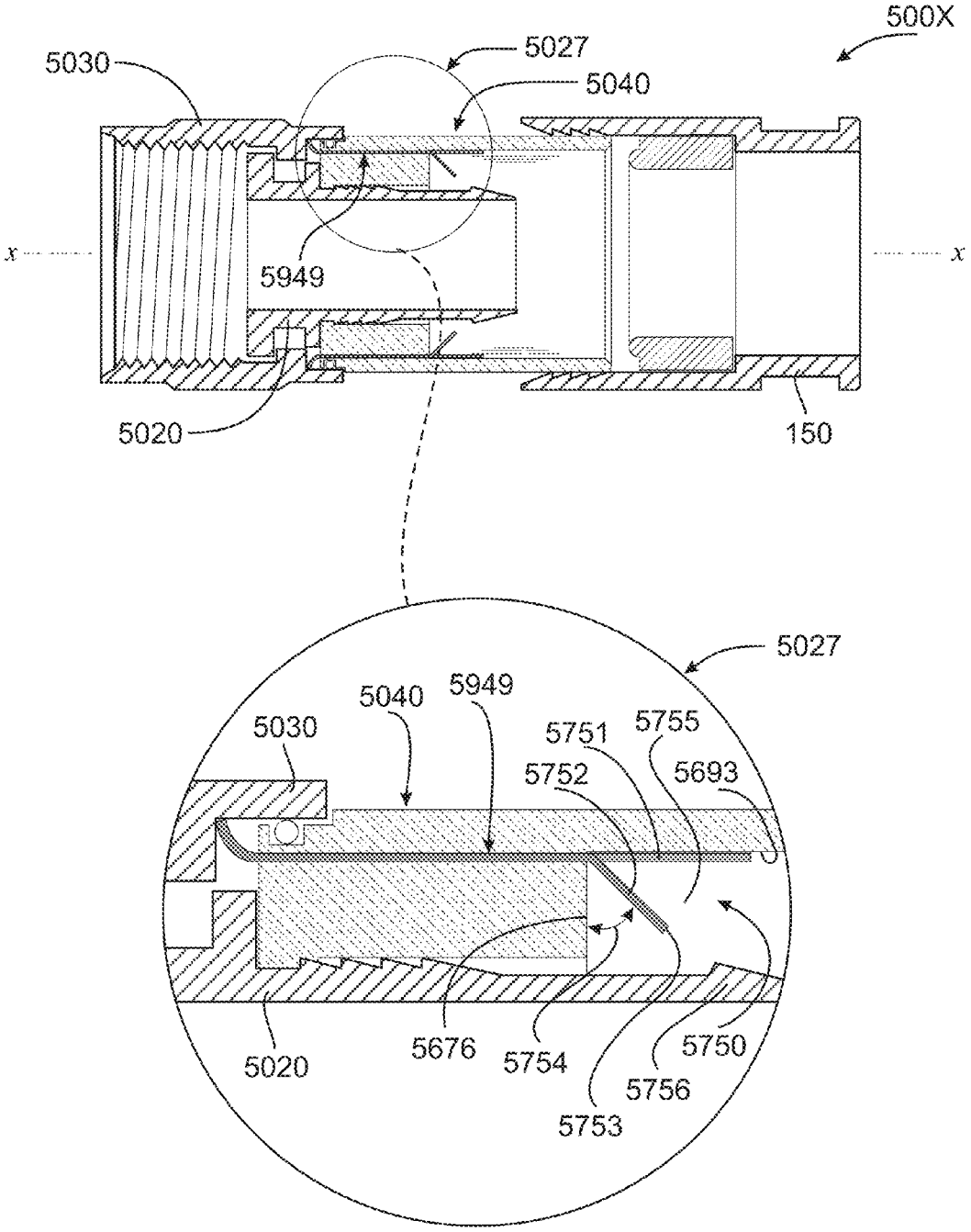

The connector of FIG. 5X is similar to the connector of FIG. 5G. However, as seen in the exploded zone 5027, the connector 500X includes a continuity bus 5949 with a rearward continuity bus portion 5750 that deforms when a coaxial cable is inserted in the connector cable receiving zone 5755. In particular, the rearward bus portion 5750 protrudes from a body rear shoulder 5676, has a first section 5751 extending alongside a body interior 5693 and a second section 5752 and second section end 5753 angled toward the connector axis X-X such that an angle 5754 is formed between the second section and a body internal shoulder 5676, the shoulder being about perpendicular to the connector axis. When a coaxial cable is inserted into a cable receiving zone 5755, turned back braid of the cable contacts the angled second section. In various embodiments, the second section springingly engages the cable braid. And in various embodiments, the cable braid contacts the first section.

Figures 5A, 5Y, 5Z:
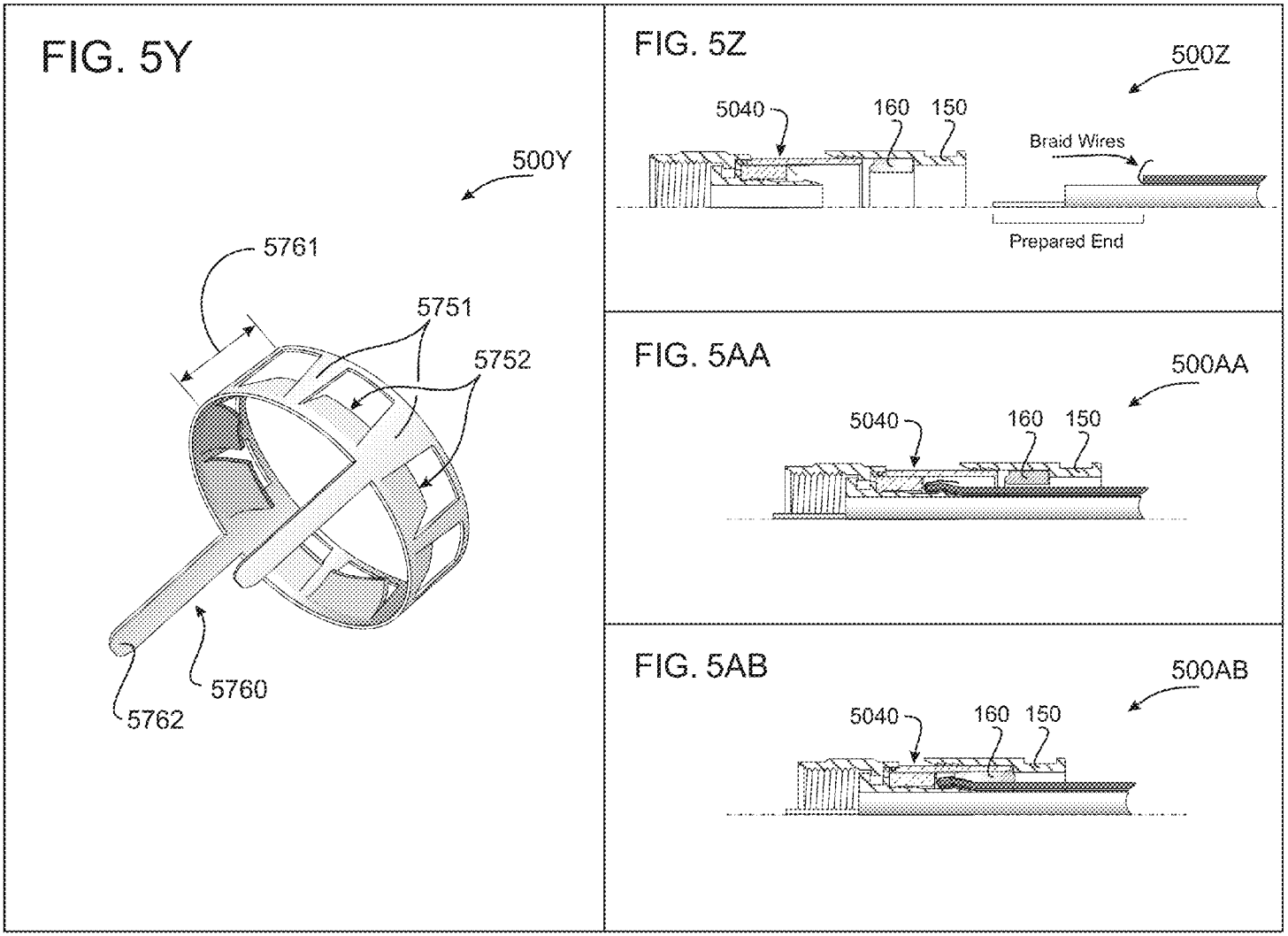
Figure 5A:
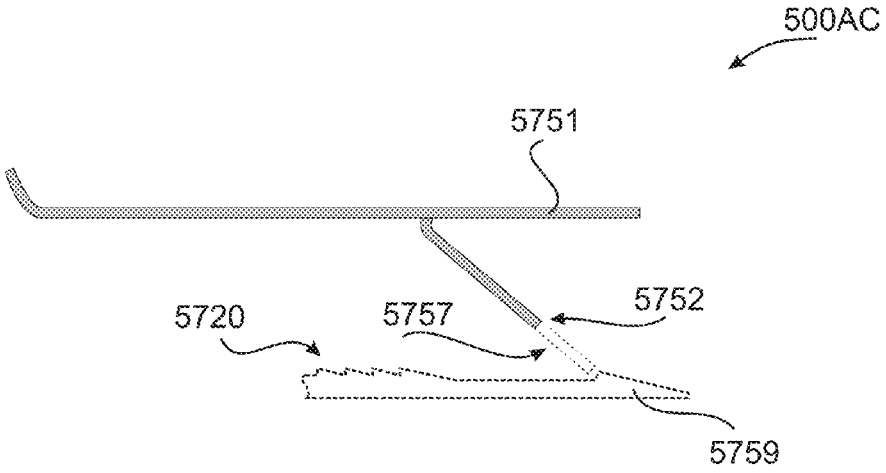
Figure 5A:
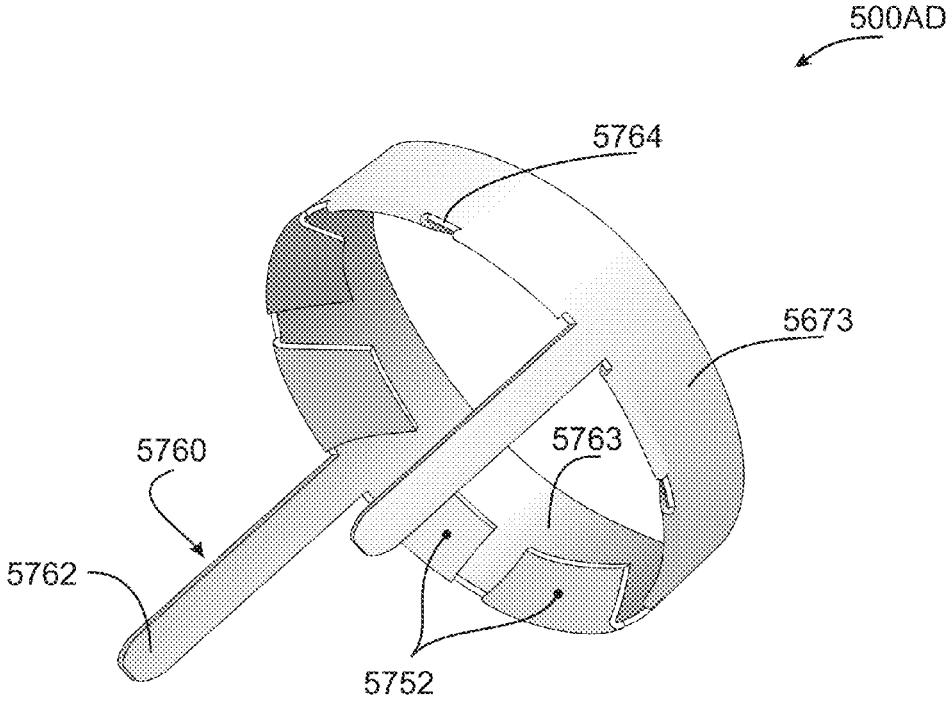
Figure 5A:
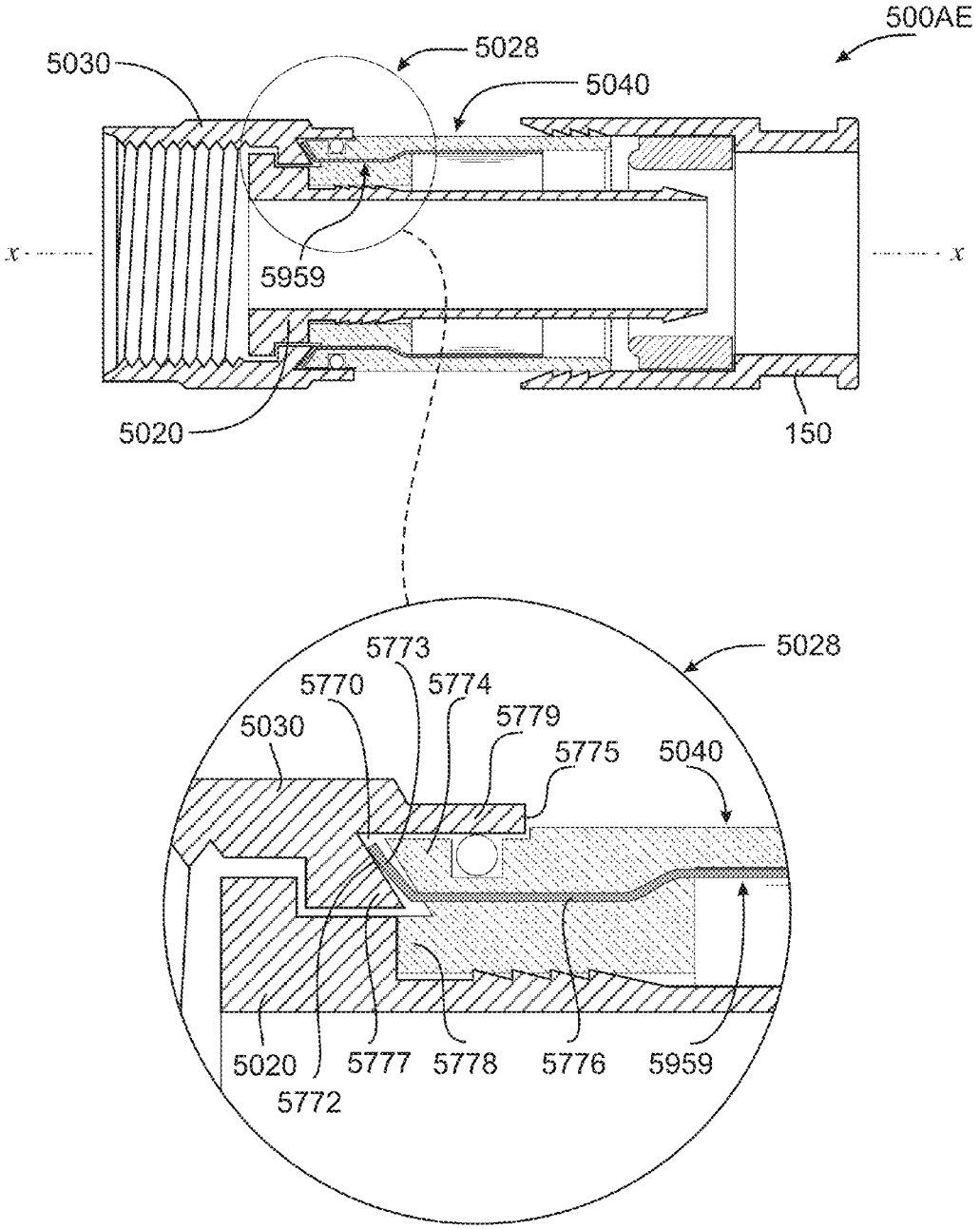
Figure 5A:
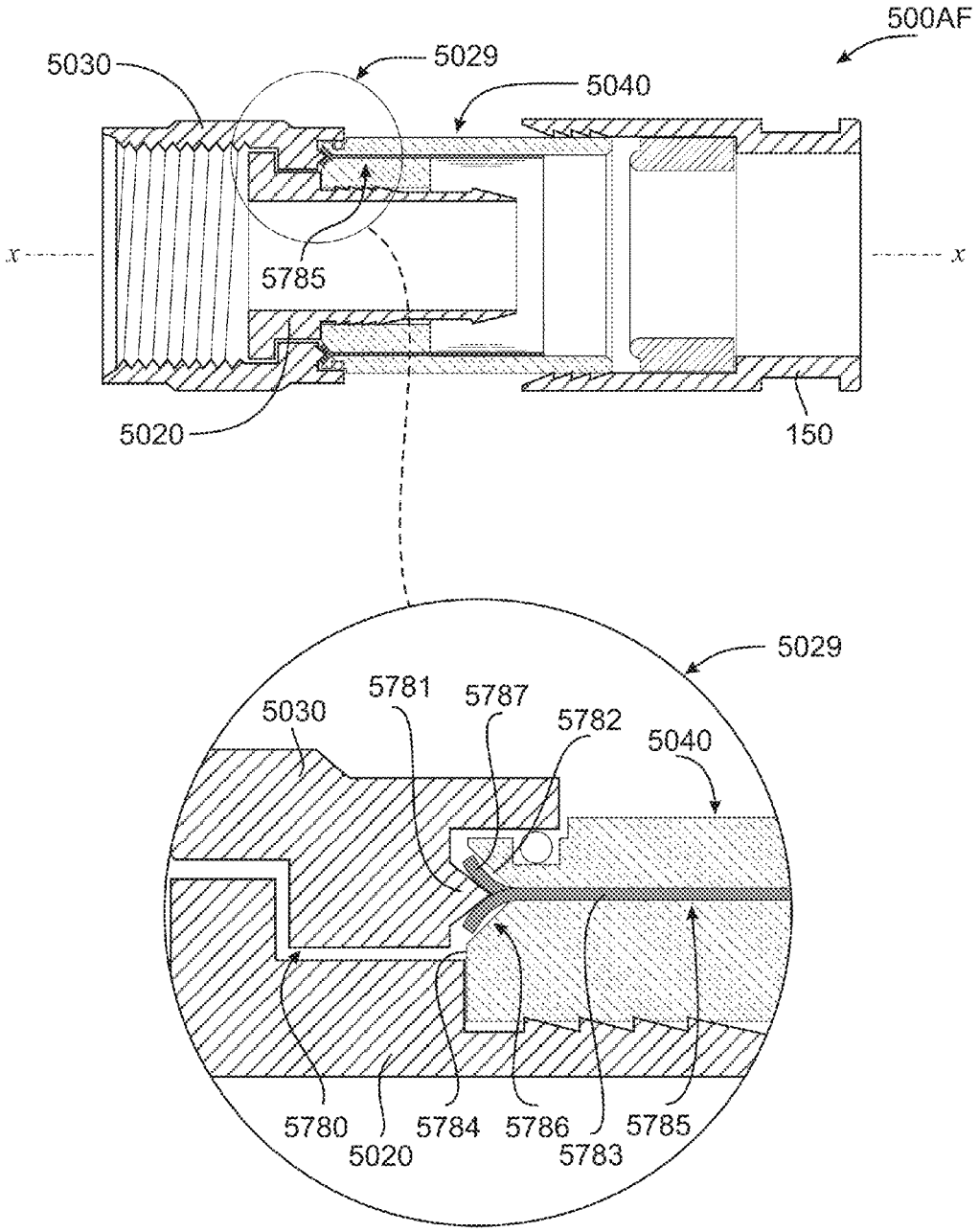

FIG. 5Y shows a first embodiment 500Y of the continuity bus 5949 of the connector of FIG. 5X. Bus fingers 5760 with finger ends 5762 project from a generally cylindrical ring 5761 from which plural angled second sections 5752 are punched leaving axially extending first sections 5751 therebetween. The generally cylindrical ring is for locating in the coaxial cable receiving space 5755 while the fingers are for passing through the body and contacting e.g., the fastener 5030 and/or the post 5020.

FIGS. 5Z-AB show insertion of a coaxial cable into a connector fitted with the coaxial bus of FIG. 5Y. In FIG. 5Z, the cable is prepped with turned back braid but not yet inserted in the connector. In FIG. 5AA, the cable is inserted in the connector such that the cable braid depresses the second sections of the continuity bus 5752. In FIG. 5AB, the rear shell 150 is advanced over the body such that a deformable ring 160 carried within the rear shell forces the coaxial cable against the bus second section and the post 5020.

FIGS. 5AC-AD show a second embodiment of the continuity bus 5949 of the connector of FIG. 5X. Plural spaced apart bus fingers 5760 with finger ends 5762 extend from a bus ring 5763 edge 5764 and plural spaced apart second sections 5752 extend from the same edge. In some embodiments, the spaced apart second sections are elongated 5757 in order to rest against the post 5720 at or near a post end or barb 5759. As skilled artisans will appreciate, such arrangement requires that the elongated second section be deformed if the coaxial cable is to be fully inserted in the receiving space 5755.

As shown, the second sections are folded into the interior of the ring to form the angled second sections. The bus ring and angled second sections are for locating in the coaxial cable receiving space 5755 (see e.g., FIG. 5X) while the fingers are for passing through the body and contacting e.g., the fastener 5030 and/or the post 5020.

FIGS. 5AE-AF show connectors 500AE-AF with tongue/groove interfaces.

The connector of FIG. 5AE is similar to the connector of FIG. 3D. However, as shown in the exploded zone 5028, the connector 500AE includes a tongue/groove interface where the body 5040 meets the nut 5030. In particular, the nut has a circular indentation such as a notch 5770 in its trailing face 5775 while the body has a mating forward protrusion 5774. Interposed between the indentation and the protrusion is a continuity bus 5959 finger 5776 end 5773. In some embodiments, an outer rim of the nut 5779 overhangs the body projection 5774 and a rim such as an inner of the nut 5777 overhangs a second body protrusion 5778. In various embodiments, the finger end 5773 springingly engages a wall 5772 of the nut indention.

The connector of FIG. 5AF is similar to the connector of FIG. 5AE. However, as seen in the exploded zone 5029, the connector 500AF includes a tongue/groove interface with a nut protrusion 5781 and a body indentation 5782. In the embodiment shown, a body 5040 end face 5784 includes a somewhat "V" shaped indentation 5782 which receives a mating projection 5781 extending in a longitudinal direction from a nut internal rim 5780. Interposed between the indentation and the projection is a similarly "V" shaped continuity bus 5785 finger 5783 end 5786, 5787. In various embodiments, the finger end springingly engages the nut projection.

Applicant notes that connector continuity busses mentioned herein have different forward ends, for example forward ends contacting one or both of the fastener and the post. Applicant notes that connector continuity busses have different trailing ends, for example pincer and non-pincer ends. While applicant's drawings show some of the possible combinations of forward and trailing continuity bus ends, applicant notes that other combinations are evident from applicant's disclosure. For example: a trailing pincer end combined with a forward dual contact end such as that of FIG. 5E; a trailing pincer combined with any disclosed forward end; and, a forward dual contact end combined with any disclosed trailing end.

FIGS. 6A-6D describe embodiments 600A-D of the fastener and fastener contact configuration that include coil spring end portions of a front bus projection.

Figure 6A:
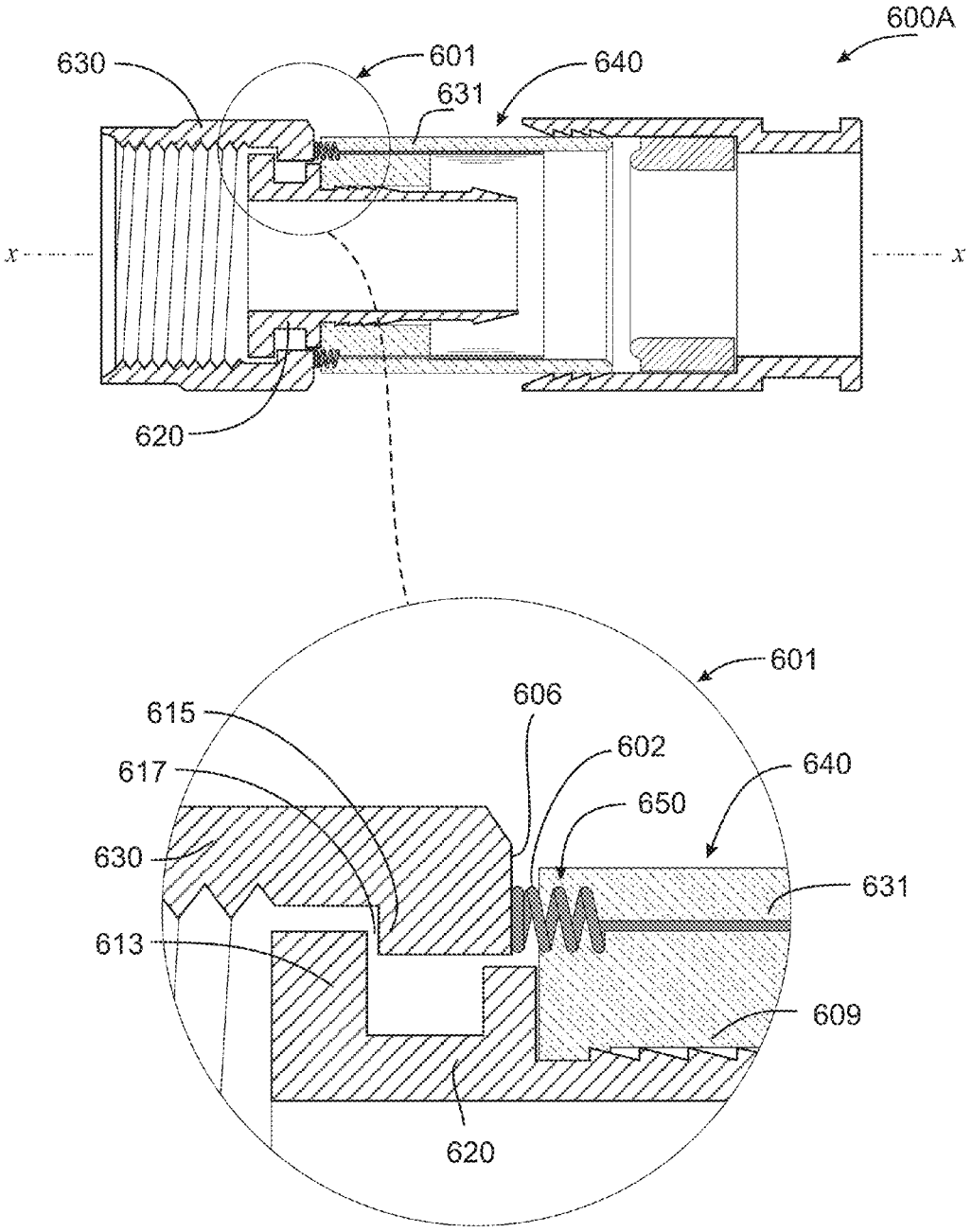
FIGS. 6A-D show cross-sectional views of continuity bus fastener contact configurations.

FIG. 6A shows a first continuity bus connector including a coil spring 600A. The connector includes a post 620 and a fastener 630 adjacent to a body 640 having a body peripheral wall 631.

An enlarged connector portion 601 shows the fastener 630 to post 620 rotatable engagement and the body 640 to post attachment. In various embodiments, the fastener is coupled to the post via a post flange 613 that interengages an inwardly directed fastener rim 615. And, in various embodiments a body neck 609 surrounds and attaches to the post near the post flange.

The continuity bus 650 is located in the body wall 631 such that a continuity bus fastener contact 602 is exposed. As shown, the fastener contact is made from a front bus projection that is coiled to form a coil spring.

When the connector of FIG. 6A is assembled, embodiments provide for contact and/or following contact between the coil spring fastener contact and a back face 606 of the fastener 630. In particular, assembly of the connector presses the fastener contact against a fastener back face. This action tends to resist formation of a gap 617 between the post flange 613 and the fastener rim 615. In various embodiments, the fastener contact acts to press the fastener rim 615 against the post flange 613 such that actions that would open the gap 617 are resisted by resilient operation of the fastener contact.

Figure 6B:
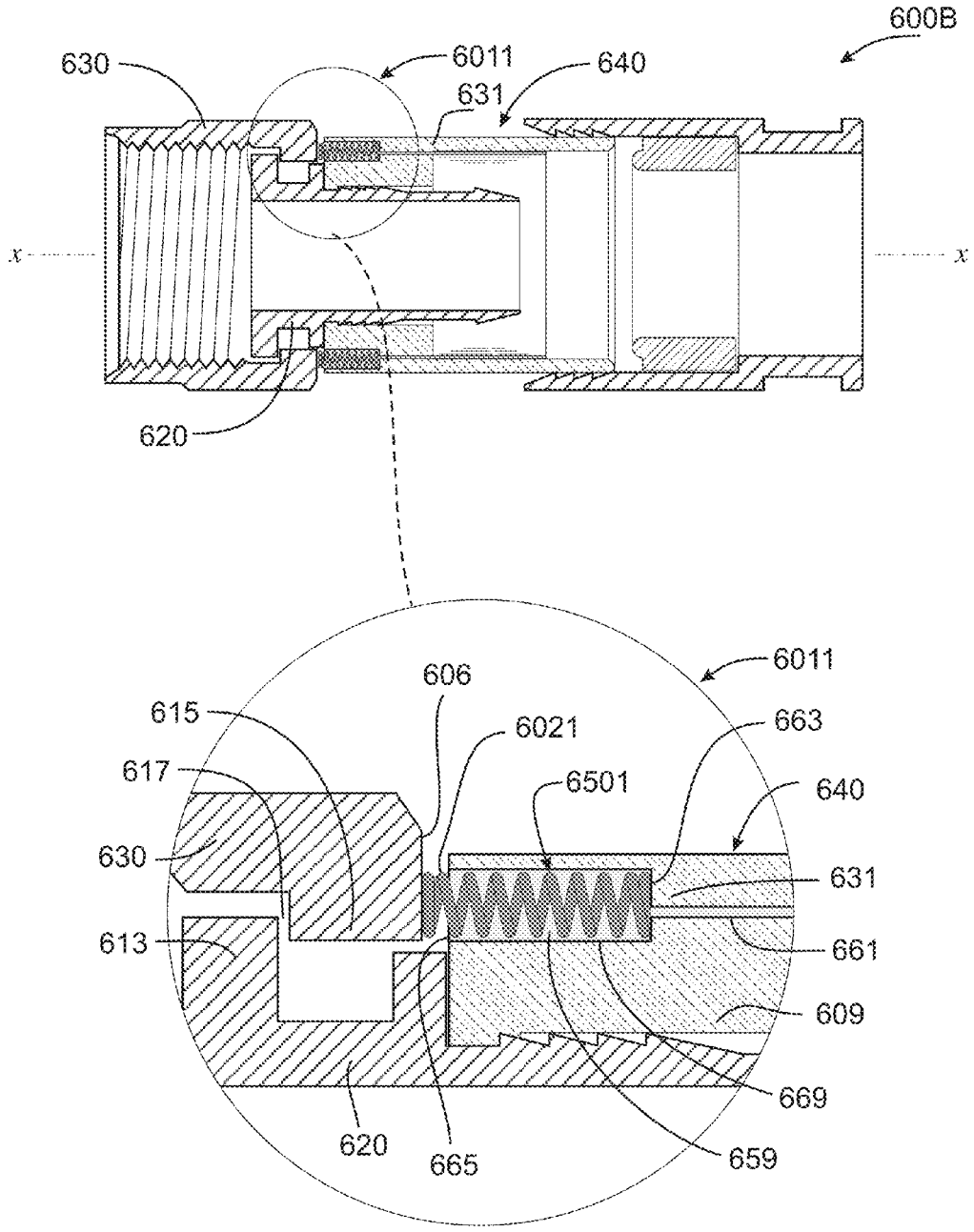

FIG. 6B shows a continuity bus connector with a coil spring 600B. The connector includes a post 620, a fastener 630 adjacent to a body 640 with a body peripheral wall 631, and is similar to the connector of FIG. 6A.

An enlarged connector portion 6011 shows a multipart continuity bus 6501 of this connector is located in the body wall 631 such that a continuity bus fastener contact 6021 is exposed. The fastener contact is in the form of a coil spring interconnected 663 (as by a disc shaped metal pusher plate or another continuity maintaining connection) with a mid-section 661 of the continuity bus.

In an embodiment (as shown), the coil spring fastener contact 6021 is inserted in a mouth 665 of a bore 659 of the body wall 631. Notably, various embodiments provide a plurality of bores with coil spring fastener contacts attached to one or more continuity bus mid sections. In some embodiments, the bore 659 is lined with a sleeve 669. And in some embodiments the sleeve is a metallic sleeve that may be interconnected with the bus mid-section 661.

When the connector of FIG. 6B is assembled, embodiments provide for contact and/or following contact between the coil spring fastener contact and a back face 606 of the fastener 630. In particular, assembly of the connector presses the fastener contact against a fastener back face. This action tends to resist formation of a gap 617 between the post flange 613 and the fastener rim 615. In various embodiments, the fastener contact acts to press the fastener rim 615 against the post flange 613 such that actions that would open the gap 617 are resisted by resilient operation of the fastener contact.

Figure 6C:
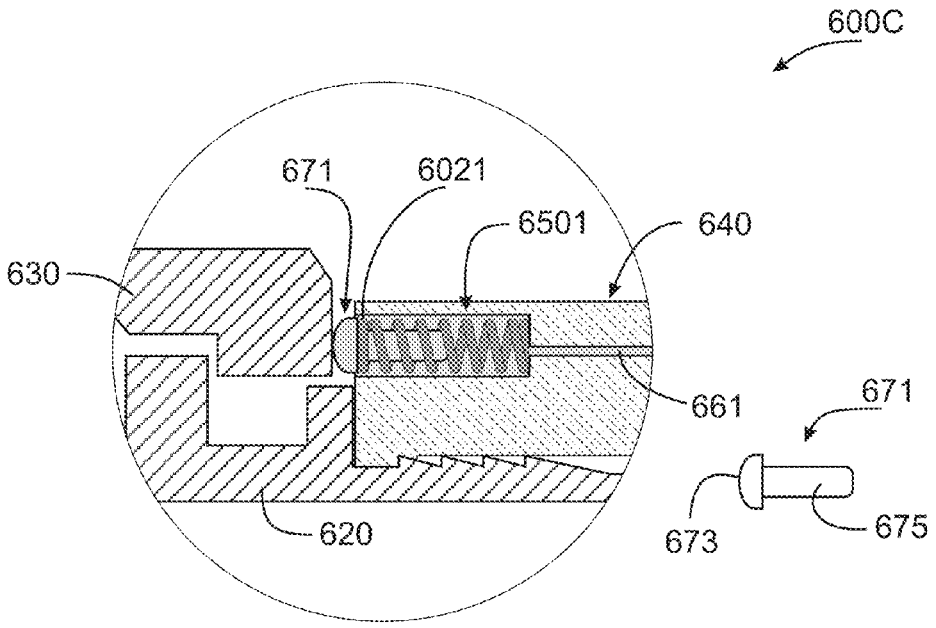

FIG. 6C shows a first alternative embodiment of the enlarged connector portion of FIG. 6B 600C. In particular, the coil spring is used to bias an electrically conductive rider or brush 671 against the fastener 630. As shown, the rider has a contacting face 673 at one end for contacting the fasteners. At another end, the rider has a shank 675 for insertion in the coil spring.

Figure 6D:
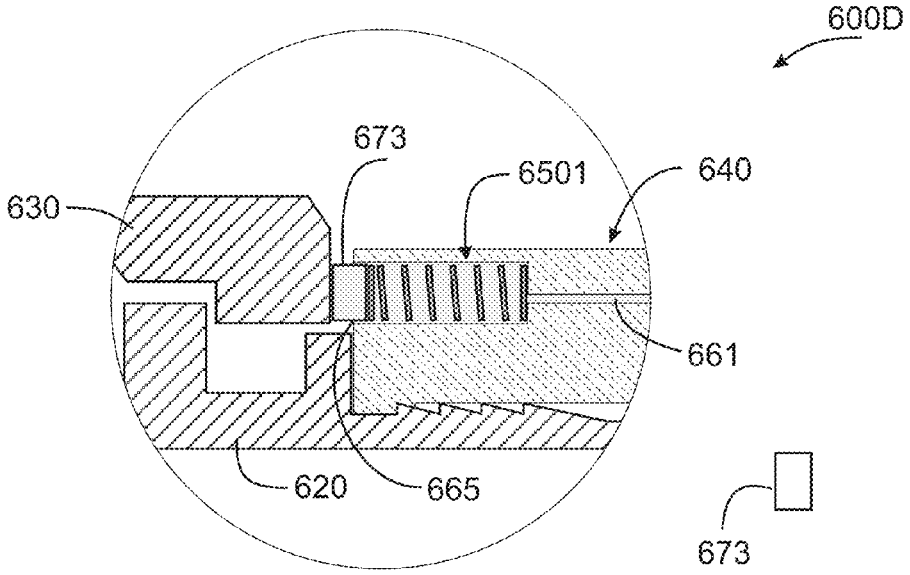

FIG. 6D shows a second alternative embodiment of the connector of FIG. 6B. Here, the coil spring 6501 pushes a piston like brush 673 from a body bore 665 into contact with the fastener 630. In some embodiments, the piston has no shank (as shown). In various embodiments, the coil spring 6501 is integral with the remainder of the continuity bus 661. And, in various embodiments the spring is not integral with, but is in electrical contact with, the remainder of the continuity bus 661.

FIGS. 5A-D and FIGS. 6A-D and the accompanying text describe various embodiments of the fastener and fastener contact configuration. Just as these embodiments vary the fastener contact configuration, so to do the embodiments which follow vary the configuration of the outer conductor contact of the continuity bus. As skilled artisans will understand, these and other embodiments disclosed provide a diverse collection of "mix and match" embodiments. For example, a selected fastener and fastener contact embodiment might be matched with a selected outer conductor contact embodiment to produce a particular continuity bus variant.

Figure 7A:
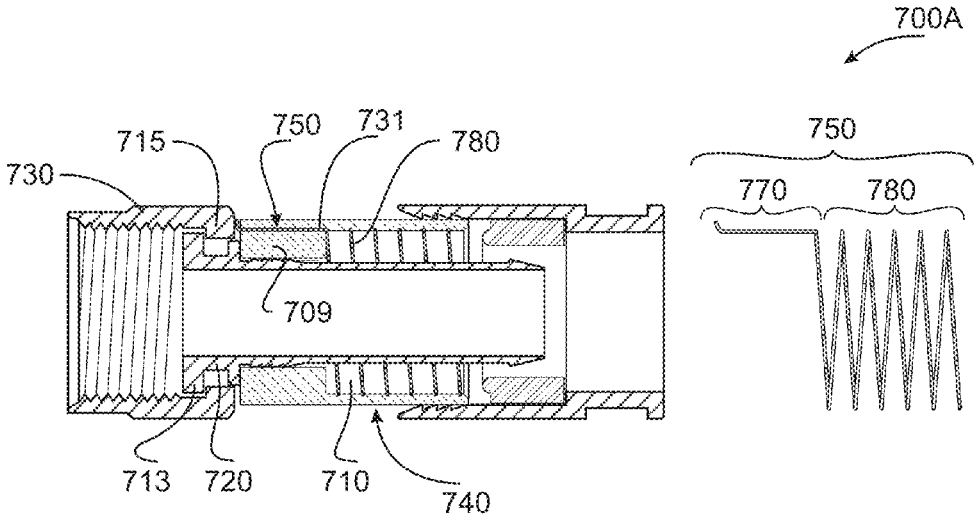
FIGS. 7A-B show cross-sectional views of continuity bus coaxial cable outer conductor contact configurations.

FIG. 7A shows a first continuity bus connector including an outer conductor coil contact 700A. The connector includes a post 720 and a fastener 730 adjacent to a body 740 having a body peripheral wall 731. In various embodiments, the fastener is coupled to the post via a post flange 713 that interengages an inwardly directed fastener rim 715. And, in various embodiments a body neck 709 surrounds and attaches to the post near the post flange.

The continuity bus 750 is located in the body wall 731 such that a continuity bus coaxial cable outer conductor contact 780 is exposed. The outer conductor contact is in the form of a coil contact inserted in an annular chamber formed between the post and the body 710.

Here, the continuity bus includes a mid-section and fastener contact 770 that adjoins the outer conductor coil. Preferred embodiments of this continuity bus 750 are made from a continuous conductor such as a conductive wire or another member suited to this application.

Figure 7B:
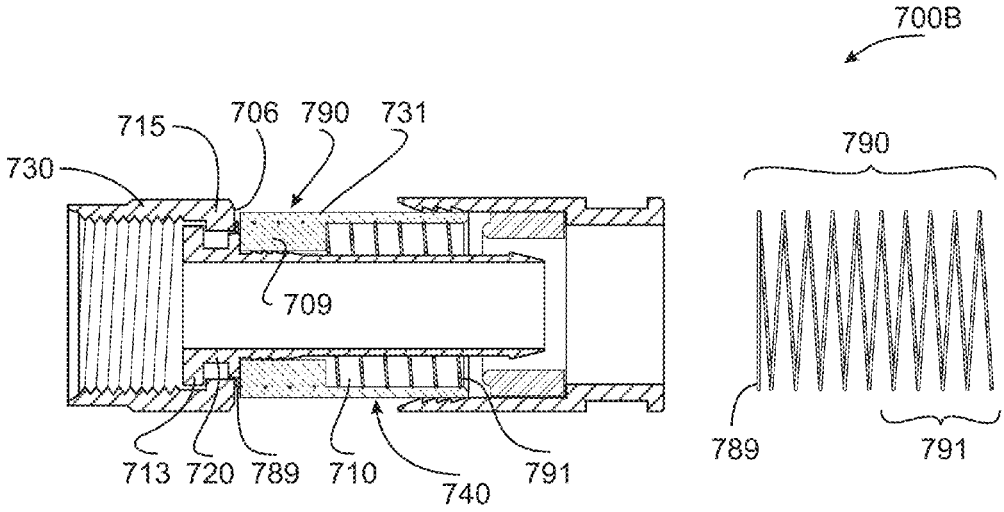

FIG. 7B shows another continuity bus connector including an outer conductor coil contact 700B. The connector includes a post 720 and a fastener 730 adjacent to a body 740 having a body peripheral wall 731 and is similar to the connector of FIG. 7A above.

The continuity bus 790 is located in the body wall 731 such that a continuity bus coaxial cable outer conductor contact 791 is exposed at one end and a fastener contact 789 is exposed at an opposed end. The outer conductor contact is in the form of a coil contact inserted in an annular chamber formed between the post and the body 710. And, the fastener contact is in the form of a coil projecting from the body and contacting a back face 706 of the fastener.

Preferred embodiments of this continuity bus 790 are made from a continuous conductor such as a conductive wire or another member suited to this application.

Yet other embodiments of the present invention utilize movable continuity busses wherein the continuity bus is pushed during insertion of a coaxial cable or during advancement of a connector rear shell.

Figure 8A:
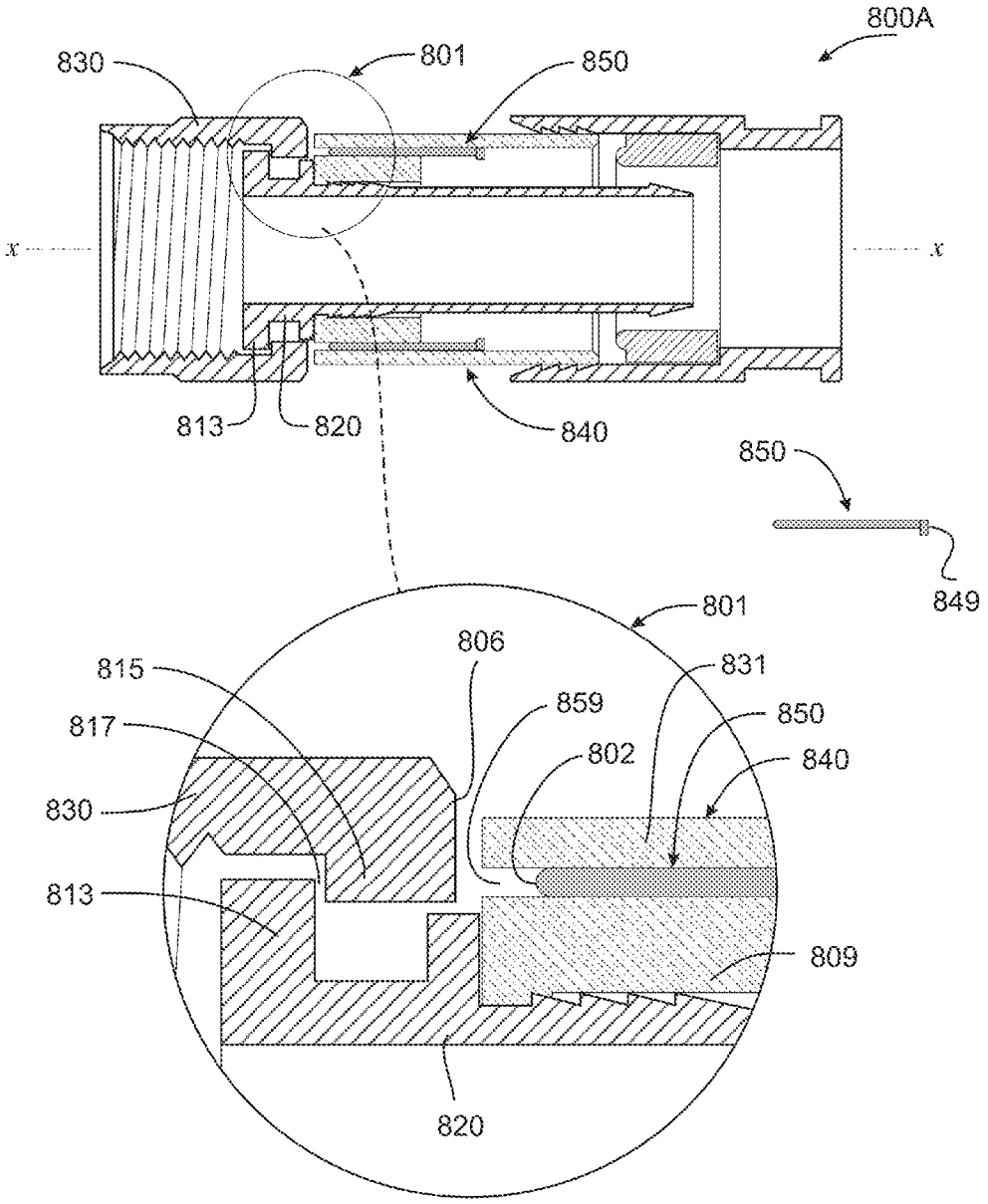
FIGS. 8A-B show cross-sectional views of coaxial cable connectors having movable continuity busses.

FIG. 8A shows a continuity bus connector including a continuity bus pushed by the coaxial cable 800A. The connector includes a post 820 and a fastener 830 adjacent to a body 840 having a body peripheral wall 831.

An enlarged connector portion 801 shows the fastener 830 to post 820 rotatable engagement and the body 840 to post attachment. In various embodiments, the fastener is coupled to the post via a post flange 813 that interengages an inwardly directed fastener rim 815. And, in various embodiments a body neck 809 surrounds and attaches to the post near the post flange.

The continuity bus 850 is located in the body wall 831 with a continuity bus fastener contact 802 is exposed at one end and a coaxial cable outer conductor contact 849 exposed at an opposed end.

While a portion of the continuity bus 850 is embedded in a void 859 in the body wall 831, the continuity bus is operable to move about parallel to the connector longitudinal axis in response to force exerted on the bus outer conductor contact 849 by the coaxial cable. Such a force pushes the continuity bus until the fastener contact 802 presses against a back face 806 of the fastener 830. As discussed above, the continuity bus is made with a suitable electrically conductive material.

When the connector of FIG. 8A is assembled and the coaxial cable is fully inserted, embodiments provide for contact and/or following contact between the fastener contact 802 and the fastener 830. In some embodiments, spring like action of the coaxial cable or the continuity bus maintains following contact between the fastener and the fastener contact. This action tends to resist formation of a gap 817 between the post flange 813 and the fastener rim 815. In various embodiments, the fastener contact acts to press the fastener rim 815 against the post flange 813 such that actions that would open the gap 817 are resisted by resilient operation of the fastener contact.

Figure 8B:
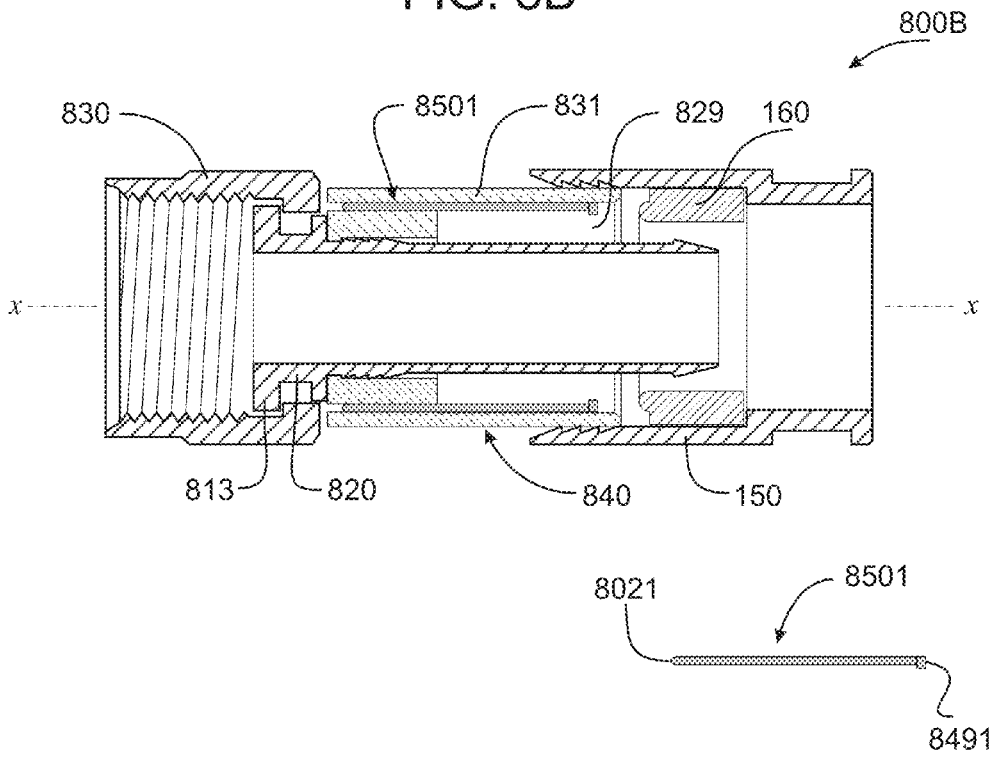

FIG. 8B shows a continuity bus connector including a continuity bus pushed indirectly by a connector end cap 800B. Similar to the connector of FIG. 8A, this connector includes a post 820 and a fastener 830 adjacent to a body 840 having a body peripheral wall 831.

A deformable ring 160 within a connector outer sleeve 150 serves to fix the cable to the connector. Fixation occurs when the sleeve is advanced onto the body, an operation forcing the ring into the annular region between the body and the post and pressing the coaxial cable jacket and outer conductor toward the post.

The continuity bus 8501 is located in the body wall 831 with a continuity bus fastener contact 8021 exposed at one end and a coaxial cable outer conductor contact 8491 exposed at an opposed end. It is noted that the length of the continuity bus is such that advancement of the rear shell and ring will cause the ring to push the continuity bus forward in a manner similar to that described in connection with FIG. 8A above.

As persons of ordinary skill in the art will appreciate, embodiments of the continuity bus of the present invention provide an electrical ground path between a coaxial cable outer conductor and an electrically conducting fastener of the connector such that the connector ground circuit tends to be maintained during events such as movement of the connector fastener relative to the connector body and failure to properly tighten the connector fastener to a female port.

While various embodiments of the present invention have been described above, it should be understood that they have been presented by way of example only, and not limitation. It will be apparent to those skilled in the art that various changes in the form and details can be made without departing from the spirit and scope of the invention. As such, the breadth and scope of the present invention should not be limited by the above-described exemplary embodiments, but should be defined only in accordance with the following claims and equivalents thereof.

The invention claimed is:

1. A continuity bus male connector for electrically connecting a cable having a central inner conductor surrounded by an outer conductor with a female connector, the connector comprising:

an electrically conductive fastener;

a non-electrically conductive body;

a post encircled by the fastener;

the post, fastener, and body in coaxial arrangement about a central axis;

a body wall encircling the post;

a continuity bus having first and second generally opposed ends;

the continuity bus passes through the body wall;

the first end of the bus protrudes into a space between the body and the post; and, the second end of the bus contacts at least one of the fastener and the post.

2. The connector of claim 1 wherein the continuity bus includes a plurality of spaced apart contacts at the second end.

3. The connector of claim 1 wherein the continuity bus includes a hoop at the first end.

4. A continuity bus male connector for electrically connecting a cable having a central inner conductor surrounded by an outer conductor with a female connector, the connector comprising:

a fastener, a post, and a body in coaxial arrangement about a central axis;

the fastener, post, and body for receiving the inner conductor;

a continuity bus passing through the body; and, a cross-section of the body reveals the continuity bus interposed between opposed plastic body walls;

wherein the continuity bus provides an electrical pathway extending from at least one of the fastener and the post to a space located between the body and the post;

wherein a continuity bus contact resiliently urges engagement of a fastener surface with an opposed post surface.

5. The connector of claim 4 wherein the space located between the body and the post is for containing at least a portion of the outer conductor.

6. A coaxial cable connector ground continuity method comprising the steps of:

providing a coaxial cable connector including a fastener, a post and a body;

fixing a coaxial cable ground conductor within an annular connector void between the post and the body;

passing a continuity bus through a wall of the connector body; and, electrically interconnecting the fastener and the coaxial cable ground conductor via a first end of the continuity bus contacting the fastener and a second end of the continuity bus contacting the coaxial cable ground conductor.

7. The method of claim 6 further comprising the step of a continuity bus contact urging the fastener against a stop located on the post.

8. The method of claim 6 wherein the continuity bus includes a hoop that substantially encircles the coaxial cable ground conductor.

9. The method of claim 6 further comprising the step of contacting the post with a contact of the continuity bus.

* * * * *